US006352469B1

(12) United States Patent
Miyazaki et al.

(10) Patent No.: US 6,352,469 B1
(45) Date of Patent: Mar. 5, 2002

(54) POLISHING APPARATUS WITH SLURRY SCREENING

(75) Inventors: Kyoichi Miyazaki, Utsunomiya; Matsuomi Nishimura, Ohmiya; Kazuo Takahashi, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/433,067

(22) Filed: Nov. 3, 1999

(30) Foreign Application Priority Data

| | | |
|---|---|---|
| Nov. 4, 1998 | (JP) | 10-313234 |
| Nov. 4, 1998 | (JP) | 10-313235 |
| Nov. 4, 1998 | (JP) | 10-313238 |
| Nov. 2, 1999 | (JP) | 11-313034 |

(51) Int. Cl.[7] ..... B24B 7/00
(52) U.S. Cl. ..... 451/67; 451/446; 451/910
(58) Field of Search ..... 451/36, 37, 60, 451/65, 67, 41, 99, 446, 447, 259, 285, 288, 910; 210/87, 167, 194, 196, 416.1, 418, 435, 663, 739

(56) References Cited

U.S. PATENT DOCUMENTS

| | | | | |
|---|---|---|---|---|
| 5,738,573 A | * | 4/1998 | Yueh | 451/287 |
| 5,791,970 A | * | 8/1998 | Yueh | 451/8 |
| 5,957,759 A | * | 9/1999 | Cardenas et al. | 451/60 |
| 5,993,647 A | * | 11/1999 | Huang et al. | 210/87 |
| 6,039,635 A | * | 3/2000 | Mitsuhashi et al. | 451/72 |
| 6,051,139 A | * | 4/2000 | Lin et al. | 210/416.1 |
| 6,106,714 A | * | 8/2000 | Chiu et al. | 210/321.63 |
| 6,106,728 A | * | 8/2000 | Iida et al. | 210/743 |
| 6,183,341 B1 | * | 2/2001 | Melcer | 451/5 |

* cited by examiner

*Primary Examiner*—Timothy V. Eley
(74) *Attorney, Agent, or Firm*—Fitzpatrick, Cella, Harper & Scinto

(57) ABSTRACT

A polishing apparatus and a polishing method can effectively prevent large diameter particles from being fed with slurry to an object to be polished. A large-diameter particle screener blocks or disperses large diameter particles from entering the slurry. Then, slurry free from large diameter particles is taken up from a slurry container by an intake pipe and fed to the object to be polished.

20 Claims, 21 Drawing Sheets

POLISHING APPARATUS WITH SLURRY SCREENING

BACKGROUND OF THE INVENTION

1. Field of the Invention

Chemical mechanical polishing (CMP) apparatus are known as apparatus for high precision polishing operations to be conducted on SOI substrates, semiconductor wafers made of Si, GeAs and/or InP, wafers carrying an insulation film or a metal film on the surface and produced in the process of forming semiconductor integrated circuits and substrates to be used for displays in order to meet the demand for extra-miniaturization and multi-level arrangement of semiconductor devices in recent years.

2. Related Background Art

Firstly, a known CMP apparatus will be described by referring to FIG. 21 of the accompanying drawings. FIG. 21 schematically illustrates a known CMP apparatus. Referring to FIG. 21, an object of polish (wafer) 100 is held by an object-of-polish-holding means 300 with the surface to be polished facing downward and polished by means of a polishing pad 200 typically made of polyurethane and having a caliber greater than the diameter of the object of polish 100. The polishing pad 200 normally has undulations on the surface or is porous. The object of polish 100 is driven by a drive means (not shown) to rotate in the direction indicated by arrow S in FIG. 21. On the other hand, the polishing pad 200 is held by a platen 400 and driven by another drive means (not shown) to rotate in the direction indicated by arrow T in FIG. 21. As the object of polish 100 and the polishing pad 200 are made to abut each other under this condition, the contact surface of the object of polish 100 is polished.

During this operation, a polishing agent (slurry) is fed from a slurry supply means 500 to between the object of polish 100 and the polishing pad 200 that are held in touch with each other. Such a polishing agent typically contains fine particles (polishing particles) of $SiO_2$ having a size of sub-microns to microns and dispersed in an alkaline aqueous solution. As slurry is supplied to the object of polish, the latter is finely polished. In FIG. 21, slurry is fed to between the object of polish 100 and the polishing pad 200 from the outside of the object of polish 100.

However, it is highly difficult to maintain the reproducibility of the polishing effect when polishing a plurality of objects continuously by means of a polishing apparatus having a configuration as described above. For example, the objects of polish can be polished to different extents and/or some of the objects of polishing can show unexpected scars on the surface. Such scars are mostly produced by particulate aggregates of fine dirt particles of external origins and/or those of polishing particles.

Additionally, the number of particulate aggregates increases with time. Conventionally, the slurry that is found to be containing particulate aggregates to a large extent is simply disposed as waste. Then, the operator is forced to frequently monitor the extent of the particulate aggregates to consequently raise the workload on the part of the operator.

SUMMARY OF THE INVENTION

Therefore, the object of the present invention is to provide a polishing method and a polishing apparatus that can supply slurry containing no large particles to the object of polish.

According to an aspect of the invention, the above object is achieved by providing a polishing apparatus of the type comprising:

an object-of-polish-holding means for holding an object of polish; and a polishing head; and adapted to polish said object of polish by causing the polishing surface of said polishing head to abut said object of polish, while supplying slurry to said object of polish held by said object-of-polish-holding means;

said polishing apparatus further comprising:

a container (or vessel) for containing said slurry;

an intake pipe for taking up said slurry from said container; and a large-diameter-particle-screening means for screening off large diameter particles from the slurry leaving said intake pipe and being fed to said object of polish.

According to the invention, there is also provided a polishing method for supplying slurry from a container to an object of polish held by an object-of-polish-holding means and polishing said object of polish by means of a polishing head, said method comprising a step of:

supplying said slurry from said container to said object of polish by way of an intake pipe and screening off large diameter particles from the slurry leaving said intake pipe and being fed to said object of polish by a large-diameter-particle-screening means.

According to the invention, there is also provided a polishing apparatus of the type comprising:

an object-of-polish-holding means for holding an object of polish; and a polishing head; and adapted to polish said object of polish by causing the polishing surface of said polishing head to abut said object of polish, while supplying slurry to said object of polish held by said object-of-polish-holding means;

said polishing apparatus further comprising:

a container for containing said slurry;

an intake pipe for taking up said slurry from said container; and a fractionizing means for fractionizing particulate aggregates contained in the slurry flowing through said intake pipe into fine particles.

According to the invention, there is also provided a polishing method for supplying slurry from a container to an object of polish held by an object-of-polish-holding means and polishing said object of polish by means of a polishing head, said method comprising a step of:

fractionizing particulate aggregates contained in the slurry taken up from a container and flowing in a given direction into fine particles by a fractionizing means.

According to the invention, there is also provided a polishing method for supplying slurry from a container to an object of polish held by an object-of-polish-holding means and polishing said object of polish by means of a polishing head, said method comprising steps of:

fractionizing particulate aggregates contained in the slurry flowing through a flow path running in a given direction into fine particles by a fractionizing means arranged at said flow path.

According to the invention, there is also provided a polishing apparatus of the type comprising:

an object-of-polish-holding means for holding an object of polish; and a polishing head; and adapted to polish said object of polish by causing the polishing surface of said polishing head to abut said object of polish, while supplying slurry to said object of polish held by said object-of-polish-holding means;

said polishing apparatus further comprising:

a first container for containing said slurry;

a fractionizing means for fractionizing particulate aggregates contained in the slurry contained in said first container into fine particles;

a transfer pipe for transferring said slurry from said first container to a second container;

a filter arranged in said transfer pipe for screening off particulate aggregates from the slurry passing through said transfer pipe; and a feed pipe for feeding slurry from said second container to said object of polish.

According to the invention, there is also provided a polishing method for polishing an object of polish by causing the polishing surface of a polishing head to abut said object of polish, while supplying slurry to said object of polish held by an object-of-polish-holding means, said method comprising steps of:

fractionizing particulate aggregates contained in the slurry contained in a first container into fine particles;

screening off particulate aggregates from the slurry being transferred from said first container to a second container through a transfer pipe by means of a filter; and feeding slurry from said second container to said object of polish by way of a feed pipe.

According to the invention, there is also provided a polishing apparatus of the type comprising:

an object-of-polish-holding means for holding an object of polish; and a polishing head; and adapted to polish said object of polish by causing the polishing surface of said polishing head to abut said object of polish, while supplying slurry to said object of polish held by said object-of-polish-holding means;

said polishing apparatus further comprising:

a hermetically sealable container for containing said slurry;

a gas supply means for supplying gas into said container; and a feed pipe for feeding said said slurry to said object of polish.

According to the invention, there is also provided a polishing apparatus of the type comprising:

an object-of-polish-holding means for holding an object of polish; and a polishing head; and adapted to polish said object of polish by causing the polishing surface of said polishing head to abut said object of polish, while supplying slurry to said object of polish held by said object-of-polish-holding means;

said polishing apparatus further comprising:

a hermetically sealable first container for containing said slurry;

a gas supply means for supplying gas into said container; and a transfer pipe for transferring said slurry from said first container to a second container; and a feed pipe for feeding said slurry from said second container to said object of polish.

According to the invention, there is also provided a polishing method for polishing an object of polish by causing the polishing surface of a polishing head to abut said object of polish, while supplying slurry to said object of polish held by an object-of-polish-holding means, said method comprising a step of:

feeding slurry to said object of polish by way of a feed pipe by supplying gas into a hermetically sealable container containing said slurry.

According to the invention, there is also provided a polishing method for polishing an object of polish by causing the polishing surface of a polishing head to abut said object of polish, while supplying slurry to said object of polish held by an object-of-polish-holding means, said method comprising steps of:

transferring said slurry to a second container by way of a feed pipe by supplying gas into a hermetically sealable first container containing said slurry; and feeding said slurry from said second container to said object of polish by way of a feed pipe.

Thus, according to the invention, it is now possible to prevent large diameter particles from being fed to the object of polish with slurry and thereby from forming unexpected scars on the surface of the object of polish by means of a polishing apparatus of the type comprising an object-of-polish-holding means for holding an object of polish and a polishing head and adapted to polish said object of polish by causing the polishing surface of said polishing head to abut said object of polish, while supplying slurry to said object of polish held by said object-of-polish-holding means because said polishing apparatus further comprises a large-diameter-particle-screening means.

Additionally, large diameter particles passing through the intake pipe can be fractionized by arranging a fractionizing means at the intake pipe as a large-diameter-particle-screening means.

Alternatively, large diameter particles passing through the intake pipe can be screened off by arranging a filter at the intake pipe as a large-diameter-particle-screening means.

Alternatively, large diameter particles can be prevented from entering the container from the outside by using a hermetically sealable container as a large-diameter-particle-screening means.

According to the invention, it is now possible to fractionize almost all the particulate aggregates contained in the slurry flowing through a flow path running in a given direction into fine particles by a fractionizing means arranged along the flow path.

Almost all the slurry contained in the container is taken up into the intake pipe and passes therethrough. Additionally, almost all the particulate aggregates contained in the slurry flowing through the intake pipe can be fractionized by a fractionizing means arranged at the intake pipe before the slurry is fed to the object of polish.

Thus, since the slurry fed to the object of polish is free from particulate aggregates, it is now possible to prevent unexpected scars from being formed on the surface of the object of polish.

According to the invention, almost all the particulate aggregates contained in the slurry in the first container can be fractionzed into fine particles. Unfractionized large diameter particles can be screened off by means of a filter. The fine particles contained in the slurry in the second container can be made to grow to show a uniform size which is preferable for polishing. Thus, slurry that is free from large particles and containing only particles of desired size can be fed to the object of polish for polishing.

According to the invention, it is possible to transfer the slurry contained in a hermetically sealable container by way of a feed pipe without being exposed to the atmosphere by supplying compressed gas into the container so that large diameter particles contained in the atmosphere can be effectively prevented from entering the slurry contained in the container.

Additionally, the slurry contained in the container is prevented from evaporating because the container is hermetically sealable.

As a result, slurry containing stably dispersed particles can be fed to the object of polish for a prolonged period of time.

DETAILED DESCRIPTION OF THE PREFERRED EMBODIMENTS

[First Embodiment]

Figure 1:
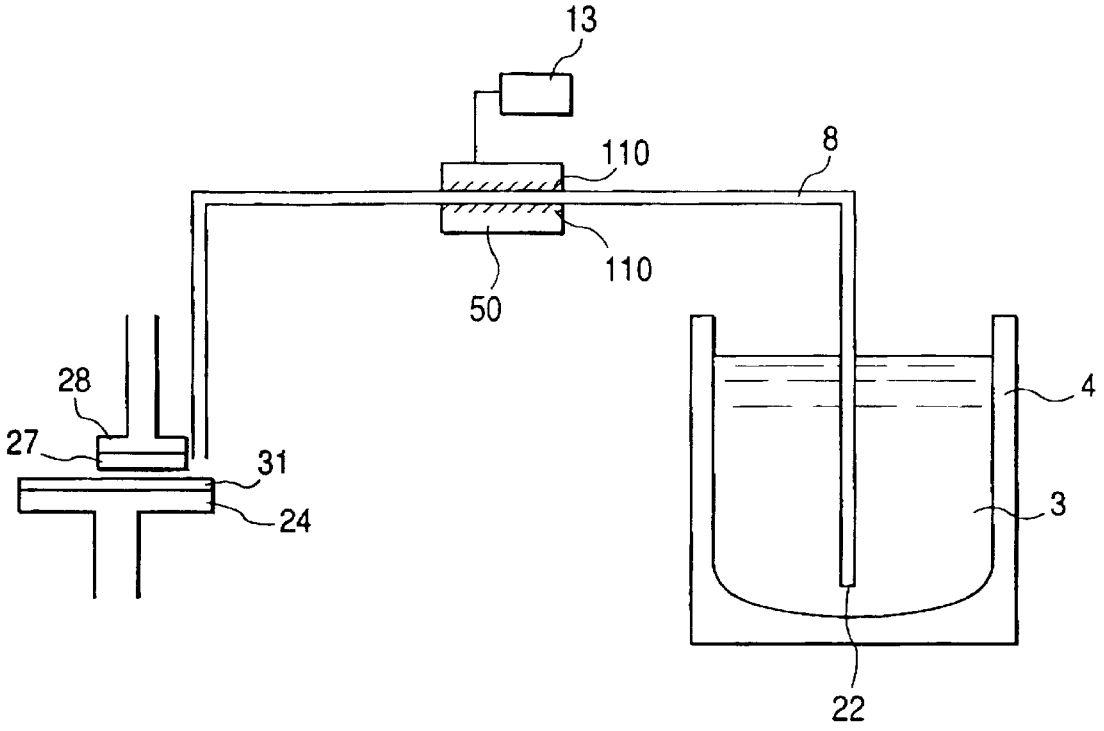
FIG. 1 is a schematic illustration of a first embodiment of a polishing apparatus according to the invention.

FIG. 1 is a schematic illustration of a first embodiment of a polishing apparatus according to the invention and comprising an object-of-polish-holding means, a polishing head, a canister (container) for containing slurry, a tube (intake pipe) for taking up slurry from the canister and a fractionizing means for fractionizing particulate aggregates (large diameter particles) in the slurry passing through the tube into fine particles.

The slurry contained in the canister 4 is liquid typically containing polishing particles of dimanganese trioxide having a size of sub-microns to microns.

The particles have a diameter that can vary within a wide range extending from 0.5 to 5 $\mu$m. Of the particles, those having a large diameter are particulate aggregates that are poorly dispersible and hence can easily precipitate in a short period of time if dispersed in a dispersing medium (liquid).

The canister 4 is provided with a tube 8 for taking up slurry 3 from the canister 4. The tube 8 has a small caliber between several millimeters and several centimeters.

The inlet 22 of the tube 8 is located at a lower part of the canister 4 so that it can not only easily collect precipitated particulate aggregates from the bottom but also take up the last drop of slurry from the canister 4.

The tube 8 is adapted to take up slurry by an intake means such as a pump and feed it to an object of polish 27 held by an object-of-polish-holding means 28. All the slurry moved to the object of polish is made to pass through the tube 8.

The object of polish 27 is brought to abut a polishing head 24 and polished by the latter.

Additionally, a fractionizing means is arranged at the tube 8 to fractionize particulate aggregates contained in the slurry passing through the tube 8 into fine particles.

The fractionizing means of this embodiment is an ultrasonic wave generation means for irradiating particulate aggregates with an ultrasonic wave. The ultrasonic wave generation means comprises an ultrasonic wave vibrator 50 and an oscillator 13. The vibration surface 110 of the ultrasonic wave vibrator 50 that produces a strong ultrasonic wave is arranged longitudinally along the outer wall of the tube 8 so that the ultrasonic wave may be applied perpendicularly to the slurry flowing through the tube 8. The vibration surface 110 is separated from the outer wall of the tube 8 by a gap of about several millimeters. The oscillator 13 applies energy of oscillation in the frequency band of sound waves or ultrasonic waves to the ultrasonic wave vibrator 50 that may be a piezoelectric ceramic actuator. The output of the oscillator 13 is several tens to several hundreds of watts per square centimeter, and the oscillation frequency is between several tense of KHz and several MHz, preferably between 20 KHz and 3 MHz.

With this embodiment of polishing apparatus, all the slurry fed to the object of polish is made to pass through the transfer pipe in a given direction, and almost all the particulate aggregates contained in the slurry flowing through the transfer pipe are fractionized into fine particles by the fractionizing means arranged at the transfer pipe before getting to the object of polish.

As a result, scars that can otherwise be produced on the surface of the object of polish during the polishing operation can be effectively avoided.

With this embodiment of polishing apparatus, since the vibration surface 110 is arranged along the tube 8 having a small caliber, a strong ultrasonic wave can be applied to all the slurry passing through the tube 8 with a minimal distance of transmission. This means that the vibration surface and the output level of the ultrasonic wave vibrator can be minimized.

In this embodiment polishing apparatus, the vibration surface may be made to show a tube-like profile and connected to the tube so as to operate as part of the flow path of slurry. In other words, the vibration surface may be made to operate as transfer pipe. With this arrangement, a strong ultrasonic wave can be applied to the particulate aggregates passing through the transfer pipe Slurry as used for this embodiment contains particles of manganese oxide, silicon oxide, cerium oxide, aluminum oxide, zeolite oxide, chromium oxide, iron oxide, silicon carbide, boron carbide, carbon or ammonium salt having a uniform size of sub-microns to microns and dispersed in an aqueous solution of sodium hydroxide, potassium hydroxide, ammonium, isocyanuric acid, Br—$CH_3OH$, isopropyl alcohol or hydrochloric acid or pure water. Any appropriate combination of the material of particles and the type of aqueous solution may be used according to the type of the object of polish. For example, a polishing agent prepared by dispersing fine particles of silicon oxide, cerium oxide, ammonium salt or manganese dioxide into a solution may suitably be used for polishing the surface of an Si wafer, and a polishing agent prepared by dispersing fine particles of silicon oxide into an aqueous solution of potassium hydroxide may suitably be used for polishing the surface of an $SiO_2$ wafer, whereas a polishing agent prepared by dispersing fine particles of silicon oxide into an aqueous solution of ammonium containing hydrogen peroxide may suitably be used for polishing the surface of an Al wafer. Objects of polish that can be polished by this embodiment of polishing apparatus include semiconductor wafers such as those containing silicon and/or Ga/As and wafers containing at least a material for forming semiconductor elements such as transistors. Other objects of polish that can be polished by this embodiment include SOI substrates and display substrates as well as substantially disk-shaped substrates and substantially rectangular substrates having orientation flats and/or notches.

For the purpose of the present invention, the object of polish may have any diameter. For example, the object of polish may have a diameter between 6 inches and 8 inches and 12 inches or greater than 12 inches.

As described above, this embodiment can effectively avoid the use of slurry containing large diameter particles and hence prevent unexpected scars from being formed on the surface of the object of polish.

[Second Embodiment]

A second embodiment of polishing apparatus according to the invention is characterized in that the vibration surface for producing an ultrasonic wave is arranged oppositely relative to the flow of slurry in the tube. Otherwise, this embodiment is identical with the first embodiment.

Figure 2:
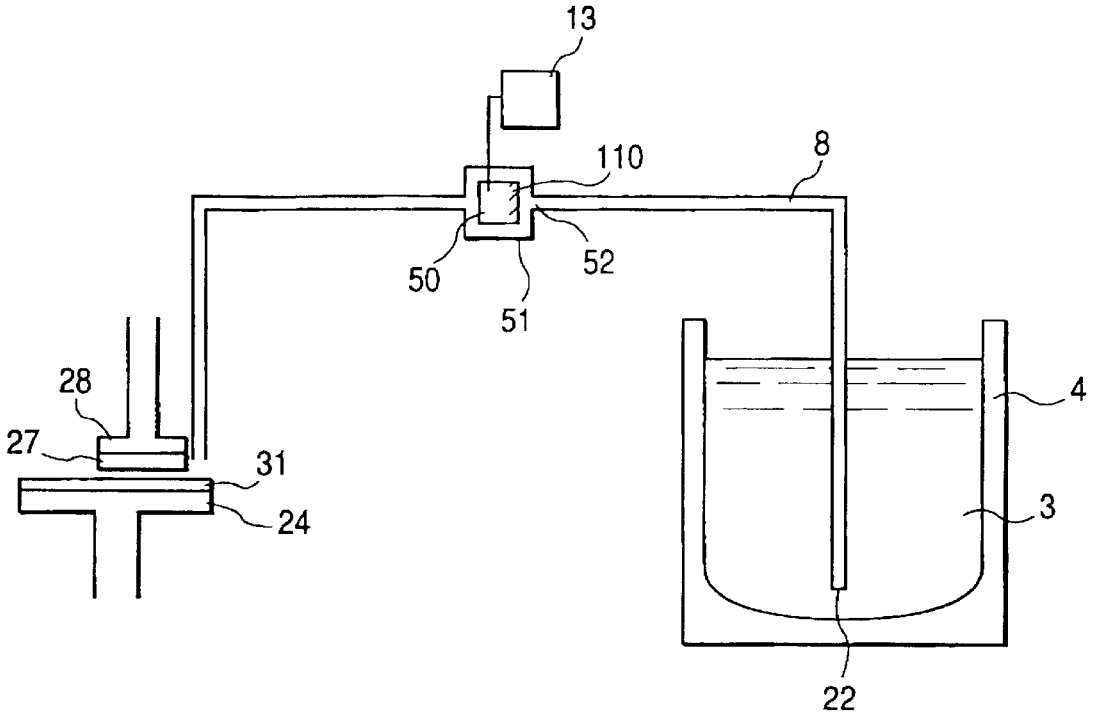
FIG. 2 is a schematic illustration of a second embodiment of a polishing apparatus according to the invention.

FIG. 2 is a schematic illustration of a second embodiment of a polishing apparatus according to the invention. As described above, the ultrasonic wave vibrator 50 is arranged on an outer wall 51 inserted into a tubes 8. The vibration surface 110 is arranged to oppose the flow of slurry in the tube 8.

The vibration surface 110 of the ultrasonic wave vibrator 50 is separated form inlet 52 of the tube 8 by several millimeters. The vibration surface 110 has an area greater than the area of the inlet 52 of the tube 8. Thus, all the slurry flowing to the outer wall 51 from the inlet 52 is made to strike the vibration surface 110.

With this arrangement, since the ultrasonic wave vibrator 50 can transmit the ultrasonic wave at close range to all the passing slurry between the inlet 52 of the tube 8 and the vibration surface 110 slightly separated from the inlet 52, any particulate aggregates contained therein can be efficiently and effectively fractionized into fine particles.

After passing by the outer wall, the slurry are made to pass through the tube 8 once again before getting to the object of polish.

Figure 3:
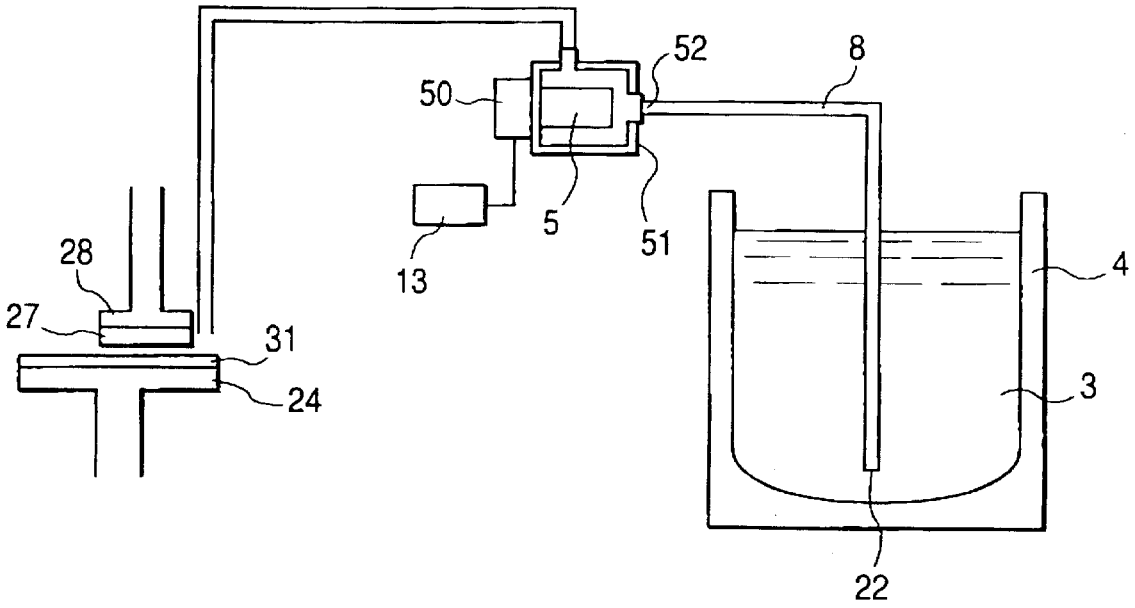
FIG. 3 is a schematic illustration of a modified second embodiment of a polishing apparatus according to the invention.

This embodiment of a polishing apparatus may be made to additionally comprise a horn 5 for amplifying the ultrasonic wave produced from the ultrasonic wave vibrator as shown in FIG. 3. Then, the vibration surface 110 is the that of the horn 5. Therefore, the vibration surface 110 of the horn 5 is preferably arranged close to the inlet 52 of the tube 8 with a minimal distance separating them.

The area of the vibration surface 110 of the horn 5 is preferably greater than that of the inlet 52. Additionally, the gap between the vibration surface 110 of the horn 5 and the inlet 52 of the tube 8 is preferably such that the ultrasonic wave may be sufficiently applied to the particulate aggregates contained in the slurry coming out of the inlet 52 by way of the gap. For example, the gap is preferably several millimeters.

[Third Embodiment]

A third embodiment of a polishing apparatus according to the invention is characterized in that it additionally comprises a circulation pipe (intake pipe) fitted to the canister and a fractionizing means is arranged at the circulation pipe for fractionizing particulate aggregates in the slurry flowing through the circulation pipe. Otherwise, this embodiment is identical with the first and second embodiments.

Figure 4:
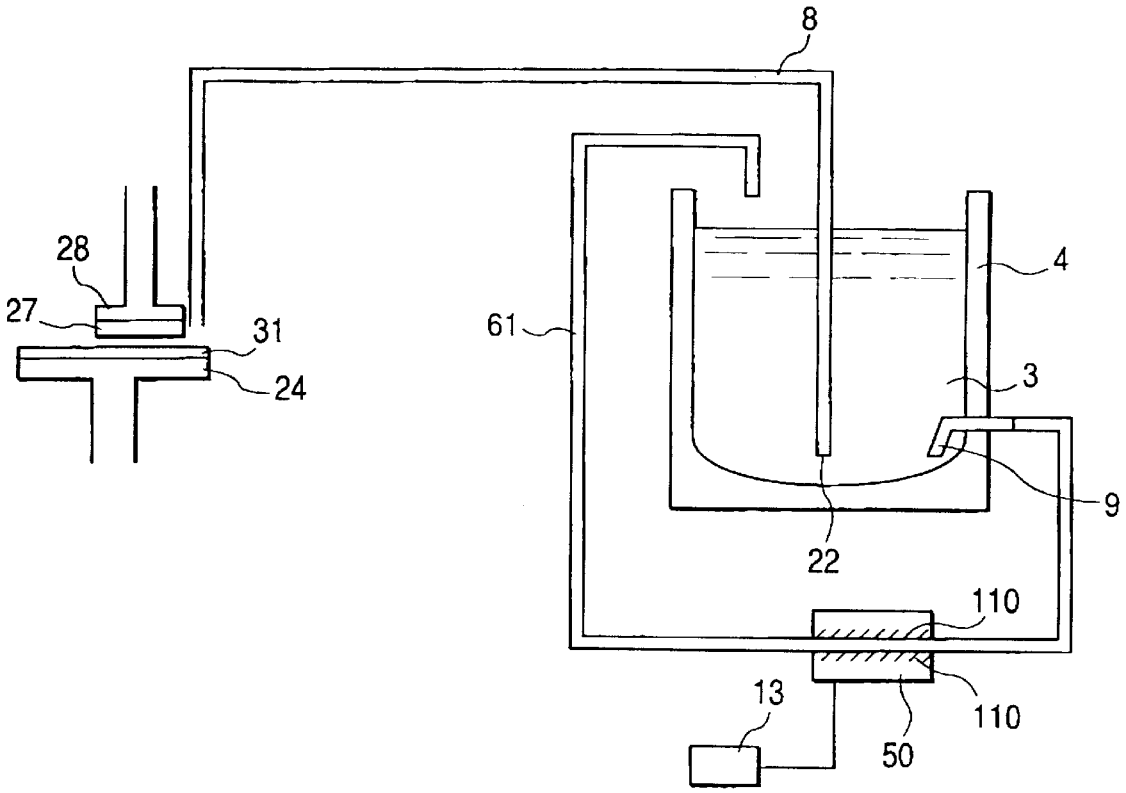
FIG. 4 is a schematic illustration of a third embodiment of a polishing apparatus according to the invention.

As shown in FIG. 4, this third embodiment of a polishing apparatus comprises a circulation pipe 61 for taking up slurry 3 from the canister 4 and delivering slurry 3 into the canister 4. The inlet port 9 of the circulation pipe 61 is disposed in a lower part of the canister 4 so that it can easily collect precipitated particulate aggregates from the bottom. The ultrasonic wave vibrator 50 is disposed at the circulation pipe 61 with its vibration surface 110 arranged longitudinally along the circulation pipe 61.

With this arrangement, the ultrasonic wave can be applied to the slurry initially contained in the canister 4 and hence to all the particulate aggregates contained in the slurry passing through the circulation pipe 61 before getting to the object of polish 27. Therefore, the number of particulate aggregates in the slurry contained in the canister 4 can be reduced to make the particles in the slurry 3 contained in the canister 4 show a uniformly dispersed condition and a uniform concentration.

With this arrangement, a uniform temperature of the slurry 3 in the canister 4 can be maintained, for the heat caused by applying ultrasonic wave to the slurry can be radiated since the slurry passes through the circulation pipe 61.

Figure 5:
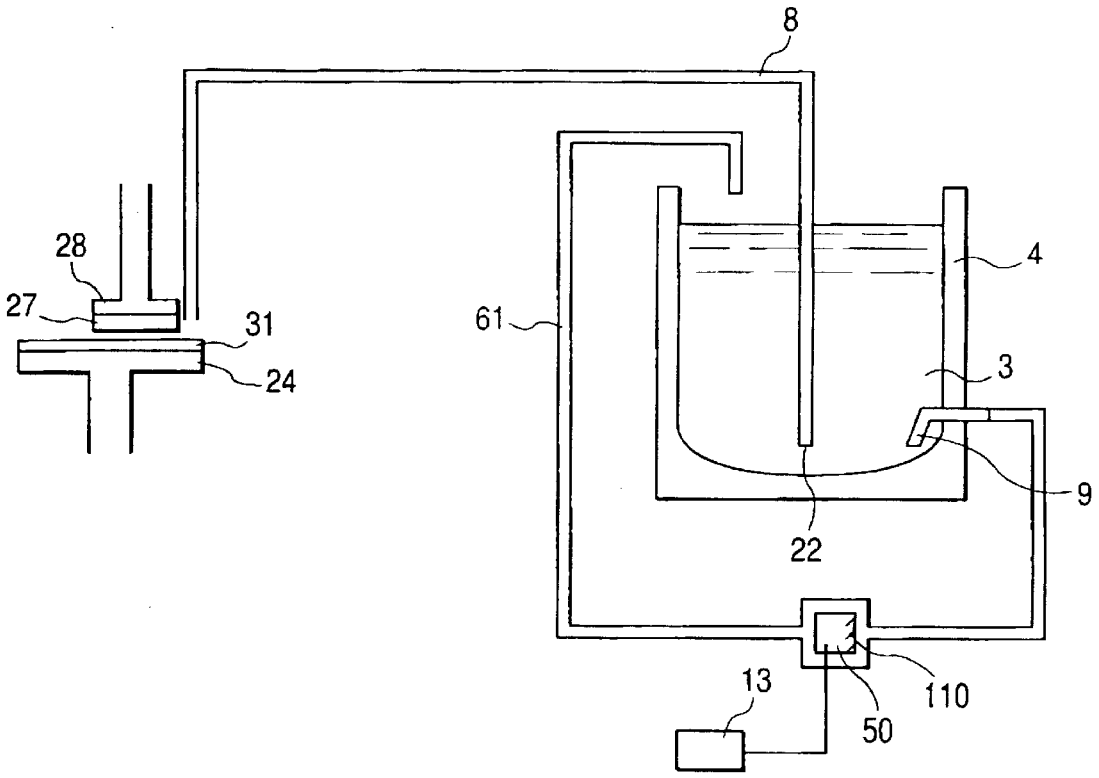
FIG. 5 is a schematic illustration of a modified third embodiment of a polishing apparatus according to the invention.

Instead of arranging the vibration surface 110 of the ultrasonic wave vibrator 50 along the tube 8, it may alternatively be disposed so as to oppose the inlet 52 of the tube 8 in a manner as shown in FIG. 5 and described above by referring to the second embodiment.

Figure 6:
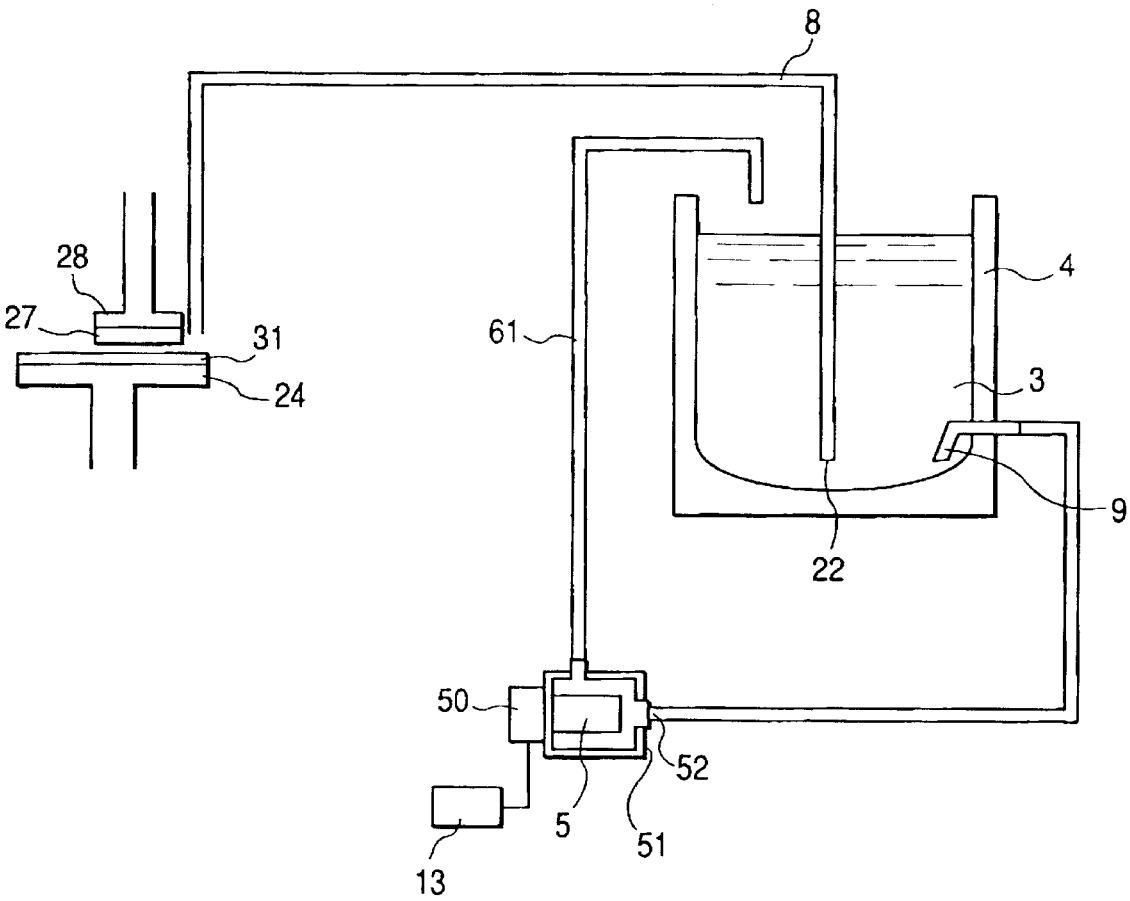
FIG. 6 is a schematic illustration of another modified third embodiment of a polishing apparatus according to the invention.

This embodiment of a polishing apparatus may be made to additionally comprise a horn 5 for amplifying the ultrasonic wave produced from the ultrasonic wave vibrator as shown in FIG. 6. Then, the vibration surface 110 of the horn 5 is preferably arranged close to the inlet 52 of the tube 8 with a minimal distance separating them. The ultrasonic wave can be efficiently applied to particulate aggregates to fractionize them into fine paritcles by arranging the horn 5.

[Fourth Embodiment]

A fourth embodiment of polishing apparatus according to the invention is characterized in that it comprises a hermetically sealable canister for containing slury and a gas supply means for supplying gas into the canister. Otherwise, this embodiment is identical with the first through third embodiments.

Figure 7:
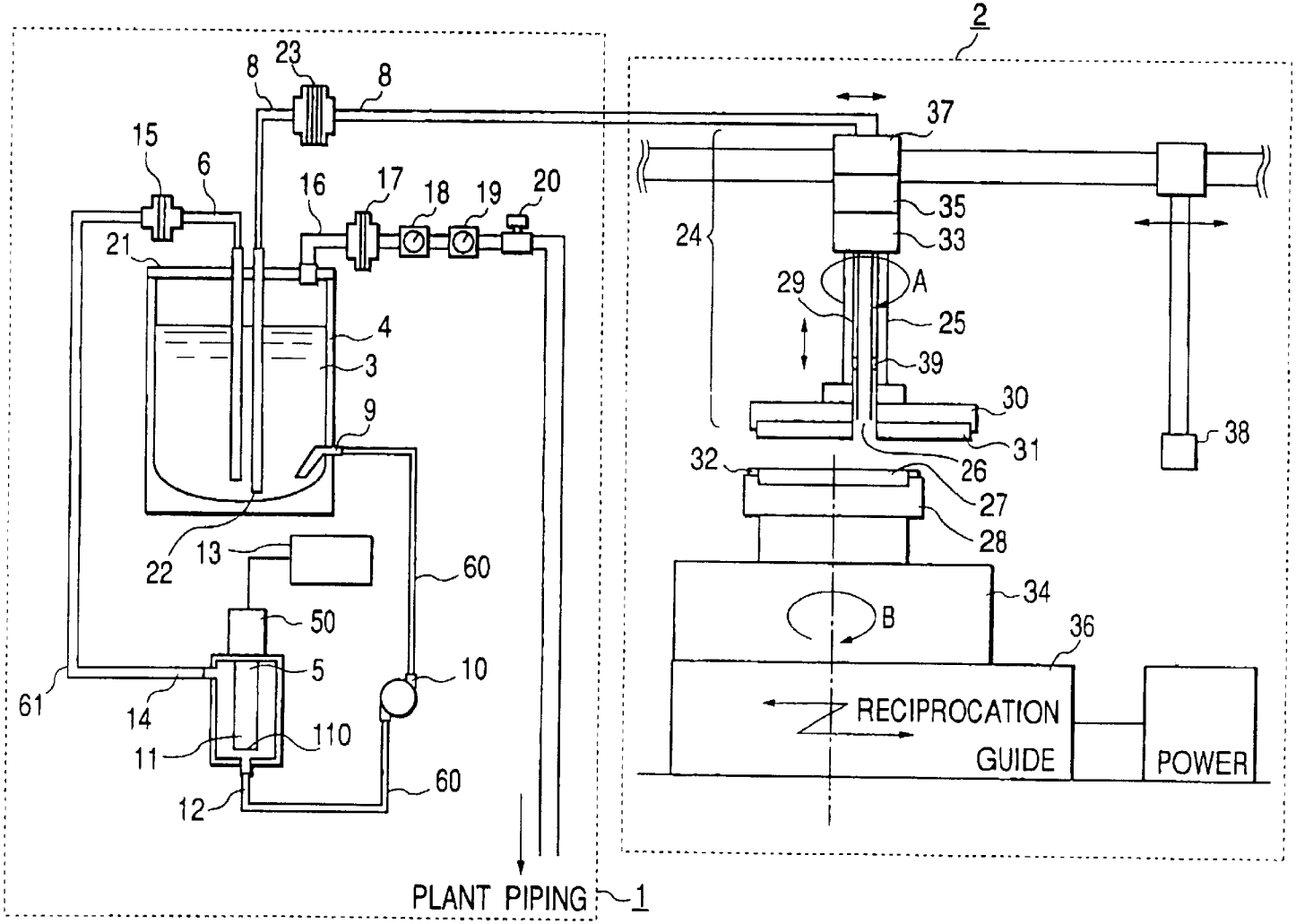
FIG. 7 is a schematic illustration of a fourth embodiment of a polishing apparatus according to the invention.

As shown in FIG. 7, the fourth embodiment of polishing apparatus comprises a particle fractionizing unit 1 and a polishing tool unit 2 for polishing the object of polish 27.

As described above by referring to the first through third embodiments, the particle fractionizing unit 1 includes a canister 4 for containing slurry 3, circulation pipes 60, 61 for taking up slurry 3 from the canister 4 and returning it to the canister 4, a fractionizing means for fractionizing particulate aggregates in the slurry into fine particles and a slurry feed pipe 8 for feeding slurry 3 from the canister 4 to the surface, to be polished, of the object of polish 27.

The canister 4 of this embodiment of polishing apparatus illustrated in FIG. 7 is hermetically sealable by a closure 21. Therefore, it can effectively prevent particles of dirt in the atmosphere from entering the slurry. Additionally, it can effectively prevent slurry 3 from evaporating.

A tube 16 is arranged as a gas supply means for supplying gas into the hermetically sealable canister 4 so that gas can be supplied into the canister 4.

The tube 16 is provided with a filter 17, a flow meter 18 and a pressure gauge 19.

The tube 16 is connected to the plant piping (not shown) so that gas can be supplied to the canister 4 by way of the plant piping. The flow meter 18 and the pressure gauge 19 are used to respectively monitor the flow rate and the pressure of the gas being supplied from the plant piping to the canister 4, and regulator 20 is used to control the flow rate and the pressure of the gas according to the readings of the flow meter 18 and the pressure gauge 19. The filter 15 is arranged midway of the gas supply pipe 16 at a position close to the canister 4 and used to produce dirt-free clean gas out of the gas supplied from the plant piping and supply it into the hermetically sealable canister 4.

Gas that can be used for this embodiment may be ordinary air or inert gas such as nitrogen gas or argon gas.

The gas supplied into the canister 4 raises the internal pressure of the canister 4 and encourages the slurry 3 in the canister 4 to be positively fed into the slurry feed pipe 8.

Slurry 3 that can be used for this embodiment may be neutral water containing cerium oxide particles as polishing particles by 10 wt. % in a dispersed state. Slurry 3 contains a mixture of primary particles with a particle diameter of about 0.02 $\mu$m and secondary particles formed through aggregation of primary particles. Such secondary particles typically shows a median diameter between 0.02 and several hundreds of microns.

The circulation pipe 60 is provided with a pump 10 that encourages slurry 3 to smoothly circulate. The pump 10 can feed the circulation pipe 60 with slurry 3 at a rate of several liters per minute.

The ultrasonic wave vibrator 50 arranged at the circulation pipe 61 is provided with a horn 5 so that almost all the particulate aggregates in the slurry flowing through the circulation pipe 61 can be fractionized into fine particles.

The front end 110 of the horn 5 is disposed so as to be opposed to a inlet 12 (or opening) of the circulation pipe 61 so that particles flowing in through the inlet 12 can be directly irradiated with ultrasonic wave. Slurry 3 flows out through a outlet 14 to the circulation pipe 61.

The circulation pipe 61 is provided with a filter 15 in order to filter out large particles that have not been fractionized by the applied ultrasonic wave and remains in slurry 3 at a very low concentration. Thus, the slurry 3 that is fed back to the canister 4 is free from large particles.

The slurry feed pipe 8 is arranged in and held in communication with another slurry feed pipe 29 that is running through the axis 25 of polishing head 24 of the polishing tool unit 2 so that slurry 3 can be fed to the surface, to be polished, of the object of polish 27 through a small aperture 26 of the slurry feed pipe 29. The temperature of slurry fed to the surface, to be polished, of the object of polish 27 is such that it does not adversely affect the polishing time and the polishing effect. The polishing tool unit 2 will be discussed in greater detail hereinafter.

The slurry feed pipe 8 is provided with a filter unit 23 at an intermediary position of the pipe 8. The filter unit 23 comprises three filters having three different respective pore sizes (pore diameters). More specifically, they are 1 $\mu$m, 0.5 $\mu$m and 0.2 $\mu$m filters arranged in the descending order as viewed from the canister 4 toward the polishing tool unit 2. With this arrangement, large particles can be filtered out without giving rise to any clogged filter from the slurry passing through the slurry feed pipe 8. As a result, the slurry fed to the surface, to be polished, of the object of polish will contain uniformly dispersed particles showing a uniform median diameter of about 0.1 $\mu$m.

Thus, this embodiment of a polishing apparatus can feed slurry from the hermetically sealable canister to the object of polish without exposing it to the atmosphere by utilizing the gas supplied from the gas supply means.

Now, the polishing tool unit 2 will be discussed in detail below.

The polishing tool unit 2 comprises a polishing head 24, an object-of-polish-holding means 28 and a surface detector.

The polishing head 24 has the slurry feed pipe 29 running therethrough, in which the slurry feed pipe 8 is arranged in a manner as described above. A holding means 39 such as a bearing is arranged between the slurry feed pipe 29 and the slurry feed pipe 8 so that the slurry feed pipe 8 is prevented from being twisted by the movement of the polishing head 24 that is revolving around the axis 25. A polishing pad 31 can be removably fitted to the platen 30 in the polishing head 24. The polishing pad 31 is held in position with its polishing surface facing downward. The polishing pad 31 is a relatively hard elastic member typically made of polyurethane and its polishing surface has fine pores of several to several hundreds of $\mu$m.

The object-of-polish-holding means 28 is adapted to hold the object of polish 27 with its surface to be polished facing upward. The object-of-polish-holding means 28 has a backing film (not shown) typically made of polyurethane and rigidly holds the rear surface of the object of polish 27 opposite to the surface to be polished. The object-of-polish-holding means 28 additionally has a substantially annular guide ring 32 for peripherally holding the object of polish 27 and preventing the latter from being laterally shifted.

The object of polish 27 is typically a semiconductor wafer carrying a material for forming semiconductor elements on the surface to be polished and has a diameter of 8 inches.

The polishing pad 31 held by the polishing head 24 has a diameter greater than that of the object of polish 27 but not greater than the twice of the diameter of the object of polish 27.

The polishing head 24 and the object-of-polish-holding means 28 are provided respectively with first and second drive means 33, 34 that are adapted to revolve in respective directions indicated by arrows A and B.

The drive means 33, 34 are also adapted to revolve at a rate of several rpm to several tens of thousands of rpm. They may be made to revolve at a same rate or at respective rates that are different from each other.

The polishing head 24 is driven to move vertically up and down by a third drive means 35 that is an abutment means so that the polishing pad 31 can be brought into abutment with the object of polish 27. The pressure applied to the object of polish 27 by the polishing pad 31 abutting the former can be controlled by a control means (not shown).

Thus, the surface, to be polished, of the object of polish 27 is polished as a result of the revolving motion of the object of polish 27 itself and that of the polishing pad 31 held in abutment with the object of polish 27.

As pointed out above, the platen 30 of the polishing head 24 has a small aperture 26 so that slurry can be evenly supplied to the surface, to be polished, of the object of polish 27 held in abutment with the polishing pad 31 by way of the small aperture. Additionally, since slurry can be continuously supplied to between the polishing pad 31 and the object of polish 27, the debris produced by the polishing operation can be delivered to the outside with the waste of slurry.

The object-of-polish-holding means 28 is provided with a fourth drive means 36 and can be reciprocated (reciprocating motion) horizontally during the polishing operation. In the present invention, "reciprocate" is to move with respect to a certain direction and can also be to cause such motion. The amplitude of the reciprocating motion is between several millimeters and several tens of millimeters and the frequency of reciprocation is several times to several tens of times per second.

The polishing head 24 is provided with a fifth drive means 37. The polishing head 24 is driven to move by the fifth drive means 37 so that the polishing pad 31 and the object of polish 27 may be positioned in such a way that their centers are not aligned with each other. More specifically, they are positioned in such a way that sum of the distance between the center of the polishing pad 31 and that of the object of polish 27 and the radius of the object of polish 27 is not larger than the radius of the polishing pad 31. During the polishing operation, the surface, to be polished, of the object of polish is entirely covered by the polishing pad 31.

As pointed out above, the polishing pad 31 has a diameter not smaller than the diameter of the object of polish 27 but not greater than the twice of the diameter of the object of polish 27. Therefore, if the object of polish 27 has a diameter of 8 inches, the diameter of the polishing pad 31 will be less than 16 inches at maximum and if, on the other hand the object of polish 27 has a diameter of 12 inches, the diameter of the polishing pad 31 will be less than 24 inches at maximum. Thus, it will be appreciated that the polishing pad 31 can be driven to rotate at high speed. When the number of revolutions per unit time of the polishing pad 31 is made equal to that of the object of polish 27 and they are driven in a same direction, the object of polish 27 is made to show a same and identical rotary speed at any point on the surface to be polished so that the object of polish 27 can be polished evenly and uniformly over the entire surface thereof.

The polishing tool unit 2 is also provided with a detector 38 for observing the surface, being polished, of the object of polish 27. When the polishing pad 31 is not entirely covering the object of polish 27, the detector 38 is moved to a position directly above the object of polish 27 to observe the surface, being polished, of the object of polish 27.

The detector 38 irradiates the surface being polished with a laser beam or a beam of white light and determines the profile of the surface being polished and the thickness of the surface film layer on the basis of the reflected beam it received. An image of the surface can be taken, enlarged and visually observed by connecting the detector 38 to an information processing means such as a computer. Then, the spot(s) to be polished further can be identified on the basis of the data obtained for the film thickness. Additionally, the data obtained by the detector 38 and the information processing means connected thereto may be utilized when selecting polishing conditions for another object of polish.

A polishing apparatus according to the invention may be provided with two or more than two horns 5. When two or more than two horns 5 are used, the flow path of slurry passing through the front end 11 of the horn 5 may be branched and the branches may be provided with respective horns 5, which are then arranged in parallel. Alternatively, the two or more than two horns 5 may be arranged in series.

While slurry 3 is encouraged to move toward the surface, to be polished, of the object of polish 27 by the high internal gas pressure of the canister 4 produced by the gas supplied into the canister 4 in the above description, it may alternatively or additionally be so arranged that the slurry feed pipe 8 is provided with a pump at a position between the inlet port 22 and the filter unit 23 in order to boost the flow of slurry getting to the surface, to be polished, of the object of polish.

With a polishing apparatus according to the invention, the polishing head 24 and the object-of-polish-holding means 28 may be driven to rotate in opposite directions instead of being driven in a same direction as described above. Still alternatively, instead of driving both the polishing head 24 and the object-of-polish-holding means 28, it is possible to drive only the polishing head 24 without rotating the object-of-polish-holding means 28. Then, the second drive means 34 for driving the object-of-polish-holding means 28 is not necessary. Still alternatively, it is possible to drive only the object-of-polish-holding means 28 without rotating the polishing head 24.

While the object-of-polish-holding means 28 of a polishing apparatus according to the invention is provided with a fourth drive means 36 for reciprocating the object of polish 27 during the polishing operation in the above description, the fourth drive means 36 may alternatively be arranged at the polishing head 24 or, still alternatively, both the object-of-polish-holding means 28 and the polishing head 24 may be provided with respective reciprocating means.

The polishing pad 31 of a polishing apparatus according to the invention may have grooves arranged to a lattice, grooves arranged concentrically or grooves arranged radially on the polishing surface. In any case, if the polishing pad 31 and the object of polish 27 are driven to rotate at a rate of several tens of rpm to several tens of thousands of rpm, the risk of transferring the pattern of the groove of the polishing pad 31 onto the surface, being polished, of the object of polish 27 can be eliminated by differentiating the number of revolutions per minute of the polishing pad 31 and that of the object of polish 27 by several rpm.

The polishing head 24 of a polishing apparatus according to the invention may be provided with a drive means (not shown) for driving the polishing pad 31 to move along an orbit while it is revolving.

In stead of providing the polishing head 24 with a drive means for driving it to revolve and a drive means (not shown) for driving it to move along an orbit, the object-of-polish-holding means 28 may be provided with such means. Still alternatively, both the polishing head 24 and the object-of-polish-holding means 28 may be provided with such means.

Still alternatively, it may be so arranged that either the polishing head 24 or the object-of-polish-holding means 28 is provided with a drive means for driving it along an orbit, while the other is not driven to rotate.

Then, the direction of revolution may be same as or opposite to the direction in which the polishing head 24 and/or the object-of-polish-holding means 28 is driven to move along an orbit, although the use of opposite directions is preferable from the viewpoint of high precision polishing.

While the polishing head 24 and/or the object-of-polish-holding means 28 may be driven to revolve around its axis and along an orbit with respective numbers of revolutions per unit time that are selected independently, they are preferably differentiated by several rpm from the viewpoint of high precision polishing.

While the polishing head 24 is located above the object-of-polish-holding means 28 of a polishing apparatus according to the invention in the above description, the polishing head 24 may alternatively be located below the object-of-polish-holding means 28. Still alternatively, the polishing head 24 and the object-of-polish-holding means 28 may be arranged horizontally opposite to each other.

While the slurry feed pipe 8 is arranged in the slurry feed pipe 29 of a polishing apparatus according to the invention in the above description, alternatively the slurry feed pipe 8 may be arranged outside the polishing head 24.

The polishing pad 31 of a polishing apparatus according to the invention may be provided with a hole that facilitates the supply of slurry through the pores 26 to the object of polish 27. Alternatively, the polishing pad 31 may be made of a material that allows slurry to pass therethrough with ease or a material that has large pores such as woven cloth.

The polishing pad 31 of a polishing apparatus according to the invention may have a diameter smaller than that of the object of polish 27. If such is the case, it is possible to polish part of the object of polish 27. Alternatively, the diameter of the polishing pad 31 may be more than twice of that of the object of polish 27.

[Fifth Embodiment]

Figure 8:
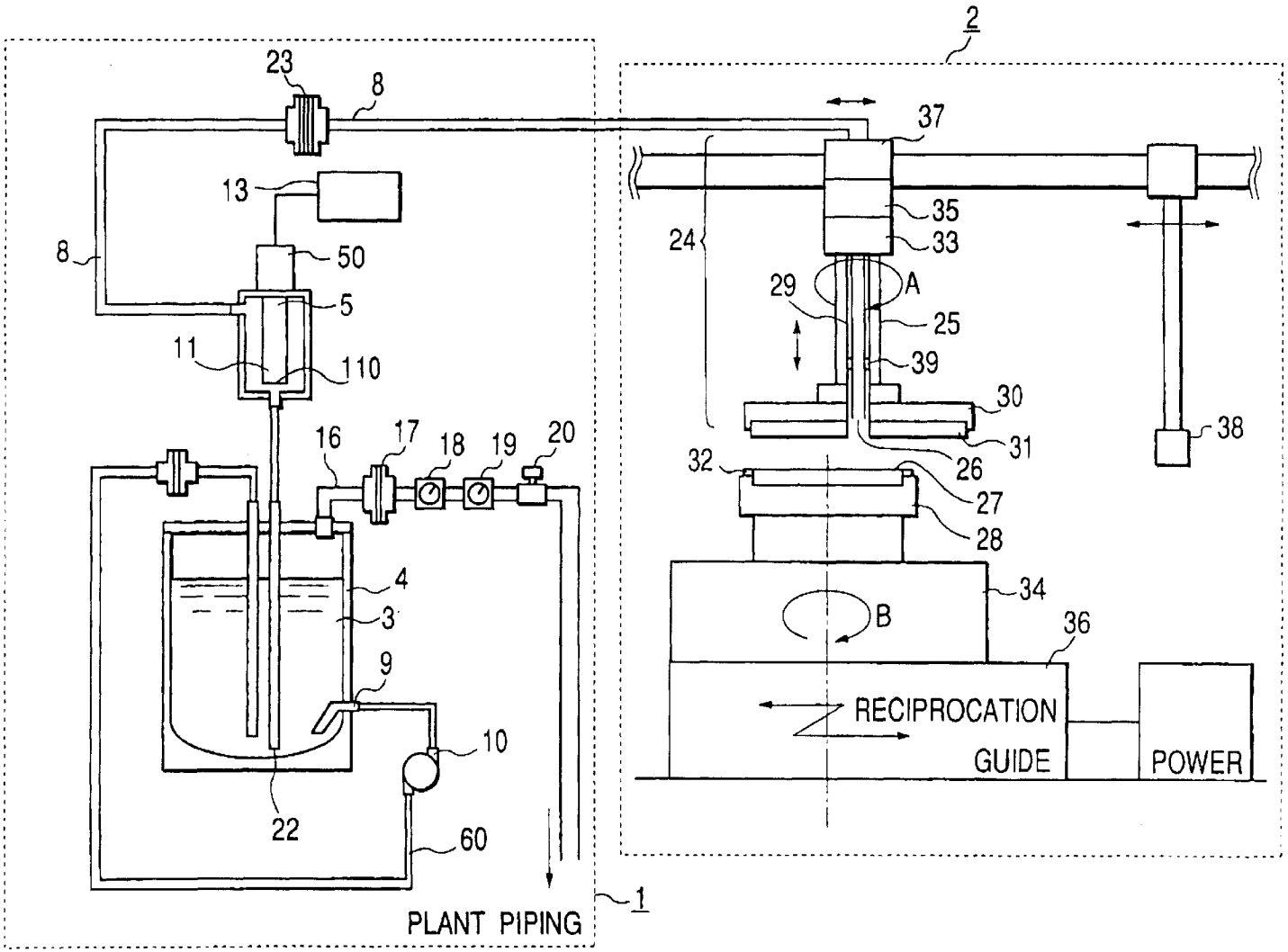
FIG. 8 is a schematic illustration of a fifth embodiment of a polishing apparatus according to the invention.

A fifth embodiment of a polishing apparatus according to the invention is characterized in that it comprises an ultrasonic wave vibrator having a horn and inserted into the slurry feed pipe 8 as shown in FIG. 8. Otherwise, this embodiment is same as the first through fourth embodiments.

The fifth embodiment of polishing apparatus according to the invention is adapted to feed slurry containing particles that are apt to aggregate on the surface, to be polished, of the object of polish 27 before they are actually aggregated.

Therefore, this embodiment of polishing apparatus can particularly suitably be used with slurry containing particles of manganese oxide that may be $MnO_2$ or $Mn_2O_3$ that is particularly apt to aggregate.

This embodiment of polishing apparatus additionally comprises a circulation pipe 6 and a pump 10. The circulation pipe 6 and the pump 10 are used to collect slurry containing particles precipitated in the canister 4 from the bottom thereof and return it to the canister 4 in order to achieve a uniform dispersion density of particles in the slurry contained in the canister 4. Then, by causing slurry 3 to pass by the vibration surface 110 of the horn 5, slurry showing a uniform dispersion density and containing no large particles (that can maintain a high polishing effect) can be fed to the object of polish.

The circulation pipe 6 and the pump 10 of this embodiment of polishing apparatus may be replaced by an air bubbling unit that is used to agitate the slurry contained in the canister 4. Alternatively, the gas supply pipe 16 of this embodiment may be used as bubbling means.

[Sixth Embodiment]

Figure 9:
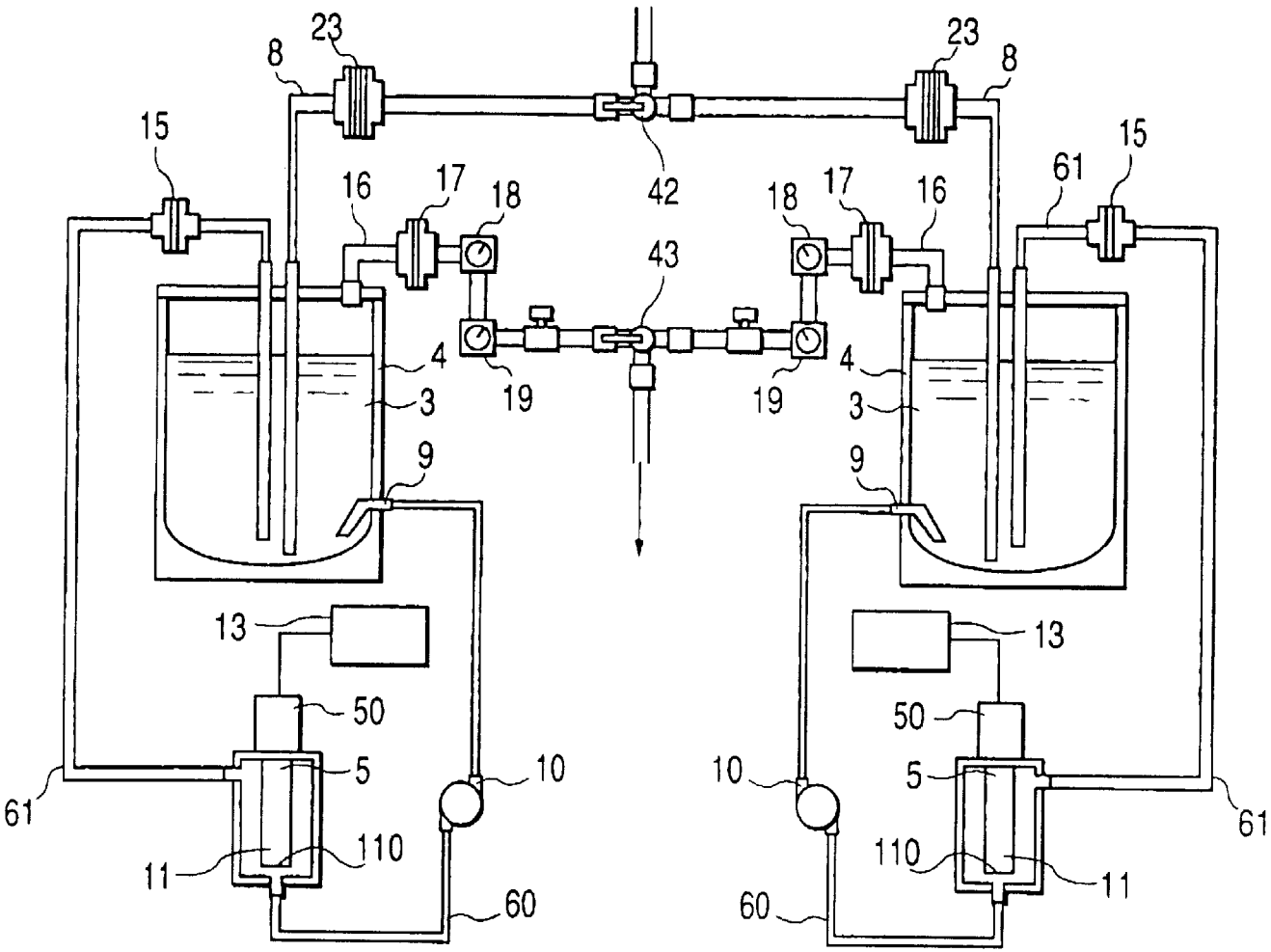
FIG. 9 is a schematic illustration of a particle fractionizing unit of a sixth embodiment of polishing apparatus according to the invention.

A sixth embodiment of a polishing apparatus according to the invention is characterized in that it comprises a plurality of particle fractionizing units 1 arranged in parallel as shown in FIG. 9. Otherwise, this embodiment is identical with the first through fifth embodiment.

Referring to FIG. 9, the canisters 4 of the plurality of particle fractionizing units 1 are linked together by way of valve 42 arranged at the slurry feed pipes 8. The valve 42 is that of a switchgear type. Thus, the slurry 3 contained in the selected one of the canisters 4 of the plurality of particle fractionizing units 1 can be fed to the surface, to be polished, of the object of polish by using the switchgear type valve 42. Additionally, the gas supply pipes 16 of the plurality of particle fractionizing units 1 are linked together by way of valve 43 arranged at the gas supply pipes 16. Thus, clean air can be supplied to the selected canister 4 by using the switchgear type valve 43 and the selected gas supply pipe 16.

The sixth embodiment of polishing apparatus according to the invention can continuously feed slurry to the surface, being polished, of the object of polish so that the problem of interrupting the polishing operation to add a large volume of slurry to the canister or that of replacing the existing slurry with slurry of different type can be conveniently avoided.

[Seventh Embodiment]

Figure 10:
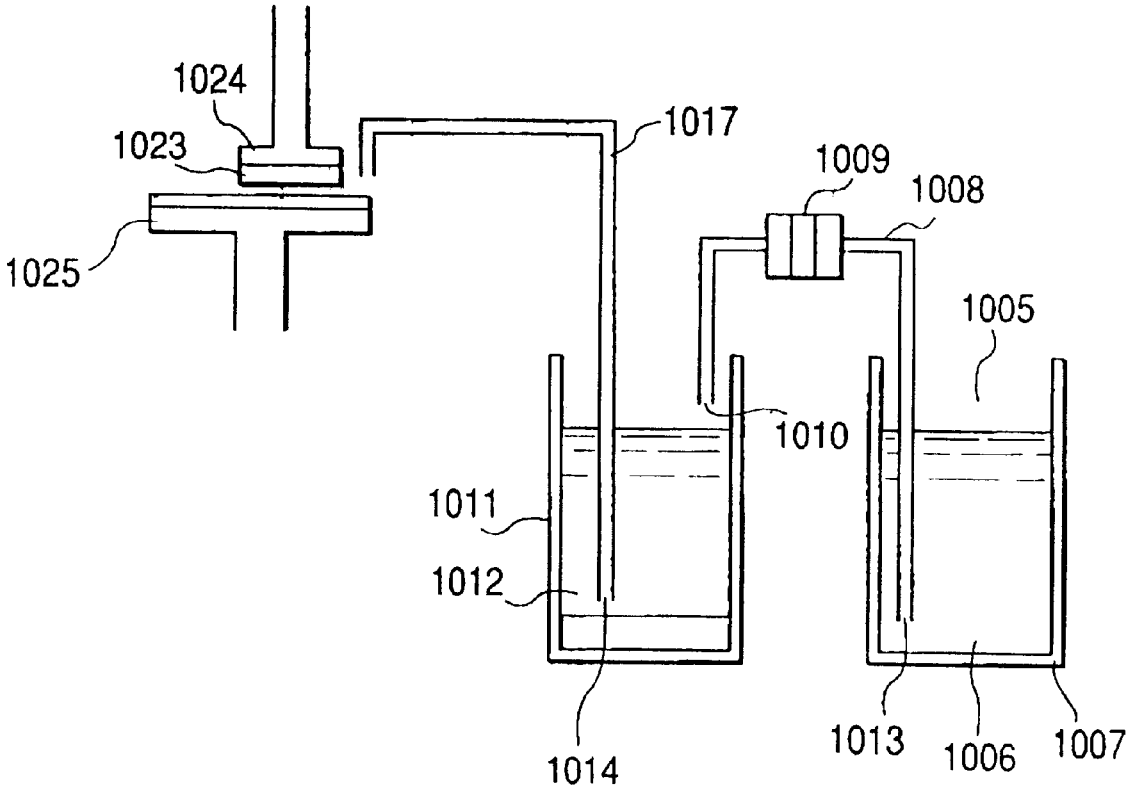
FIG. 10 is a schematic illustration of a seventh embodiment of polishing apparatus according to the invention.

A seventh embodiment of polishing apparatus according to the invention is characterized in that it comprises an object-of-polish-holding means for holding an object of polish, a polishing head, a first container for containing slurry (primary canister), a fractionizing means for fractionizing particulate aggregates into small particles arranged at the first container, a transfer pipe (tube) for transferring slurry from the first container to a second container (secondary canister), a filter unit arranged at the transfer pipe and a feed pipe (tube) for supplying slurry from the second container to the object of polish as shown in FIG. 10.

Referring to FIG. 10, in this embodiment of a polishing apparatus, a fractionizing means is arranged at the primary canister 1005 for containing slurry 1006. The fractionizing means is an ultrasonic wave generation means for fractionizing particulate aggregates, or large diameter particles, into fine particles.

The slurry 1006 contained in the canister 4 is obtained by dispersing polishing particles of dimanganese trioxide into neutral water (dispersion medium). The particles have a diameter that can vary within a wide range extending from 0.5 to 5 $\mu$m and include particulate aggregates to a large extent. The ultrasonic wave generating means 1007 can fractionize particulate aggregates contained in the slurry to a large extent into fine particles.

The transfer pipe (tube) 1008 is arranged between the primary canister 1005 and the secondary canister 1011 to transfer slurry 1006 from the primary canister 1005 to the secondary canister 1011. Slurry 1006 is transferred to the secondary canister 1011 by way of the tube 1008 by means of a pump or a gas pressure transfer means, which will be described hereinafter. The inlet 1013 of the tube 1008 is located at a level higher than the level to which the precipitate of large particles including particulate aggregates can be concentrated. Therefore, fractionized fine particles can be selectively taken up through the inlet 1013.

The filter unit 1009 is arranged at the tube 1008. The filter unit 1009 comprises three filters having three different respective pore sizes (pore diameters). More specifically, they are 1 $\mu$m, 0.5 $\mu$m and 0.2 $\mu$m filters arranged in the descending order as viewed from the primary canister 1005 toward the secondary canister 1011. With this arrangement, large particles entering the tube 1008 through the inlet 1013 can be filtered out so that slurry 1006 is moved into the secondary canister 1011 without large particles. The filters are made of polytetrafluoroethylene, cellulose, ceramic or stainless steel.

Of the particles in the slurry 1006 contained in the primary canister 1005, the particulate aggregates that are left unfractionized after the ultrasonic wave treatment are filtered out by the filter unit 1009 as they are moved from the primary canister 1005 to the secondary canister 1011 by way of the tube 1008. As a result of filtration, the slurry 1006 will contain uniformly dispersed fine particles, which show a diameter of about 0.1 to 0.3 $\mu$m when observed immediately after the filtering operation.

The outlet 1010 of the tube 1008 is located in an upper part of the secondary canister 1011 so that the slurry fed from the primary 1005 is discharged onto the surface of the slurry 1012 contained in the secondary canister 1011 from above. As a result, fine particles are constantly dispersed on and near the surface of the slurry 1012 in the secondary canister 1011. As some of the fine particles aggregate to show a large diameter, the produced particulate aggregates precipitate toward the bottom of the secondary canister 1010 from the surface.

On the other hand, fine particles in the slurry 1012 can be made to reaggregate and grow to show a diameter appropriate for polishing operations while they are staying in the secondary canister 1011. Reaggregated particles show a diameter found within a range between 0.2 and 0.6 $\mu$m.

The secondary canister 1011 is provided with a tube 1017 for transferring slurry 1006 from the secondary canister 1011 to the polishing unit which comprises at least the polishing head 1026 and the object-of-polish-holding means 1024. Slurry 1006 is fed to the object of polish 1023 by way of the tube 1017 by a pump or a transfer means (not shown), which will be described hereinafter by referring to the eighth embodiment.

The inlet 1014 of the tube 1017 is arranged at the bottom of the secondary canister 1011 at a position where reaggregated and precipitated particles are mostly concentrated. Since the inlet 1014 is located at the bottom of the secondary canister 1011, the supply of slurry 1012 to the object of polish can be maintained for a while if the transfer of slurry from the primary canister 1005 to the secondary canister 1011 is suspended. Thus, an operation of supplying additional slurry to the primary canister 1005 can be carried out while feeding slurry from the secondary canister 1011 to the object of polish 1023.

With this embodiment, a large volume of particulate aggregates can be fractionized into fine paritcles by the franctionizing means arranged at the first container. Therefore, slurry containing particulate aggregates to a large extent no longer needs to be disposed as waste because it can effectively be exploited.

On the other hand, according to the invention, large particles that are left unfractioned in spite of using the fractionizing means are removed by the filter unit so that only slurry containing fine particles will be transferred to the second container, where fine particles are made to grow to show a desired diameter.

As a result, slurry having an excellent polishing effect will be fed to the object of polish and hence the polished object will be free from scars on the surface.

With this embodiment, an agitator such as a fan may be used in addition to the ultrasonic wave generating means if such an agitator can fractionize particulate aggregates. However, the use of an ultrasonic wave generating means is particularly advantageous because it can collectively fractionize a large volume of particulate aggregates.

Slurry as used for this embodiment contains particles of manganese oxide, silicon oxide, cerium oxide, aluminum oxide, zeolite oxide, chromium oxide, iron oxide, silicon carbide, boron carbide, carbon or ammonium salt having a uniform size of several millimeters to sub-microns and dispersed in an aqueous solution of sodium hydroxide, potassium hydroxide, ammonium, isocyanuric acid, Br—$CH_3OH$, isopropyl alcohol or hydrochloric acid or pure water. Any appropriate combination of the material of particles and the type of aqueous solution may be used according to the type of the object of polish. For example, a polishing agent prepared by dispersing fine particles of silicon oxide, cerium oxide, ammonium salt or manganese dioxide into a solution may suitably be used for polishing the surface of an Si wafer, and a polishing agent prepared by dispersing fine particles of silicon oxide into an aqueous solution of potassium hydroxide may suitably be used for polishing the surface of an $SiO_2$ wafer, whereas a polishing agent prepared by dispersing fine particles of silicon oxide into an aqueous solution of ammonium containing hydrogen peroxide may suitably be used for polishing the surface of an Al wafer. Objects of polish that can be polished by this embodiment of polishing apparatus include semiconductor wafers such as those containing silicon and/or Ga/As and wafers containing at least a material for forming semiconductor elements such as transistors. Other objects of polish that can be polished by this embodiment include SOI substrates and display substrates as well as substantially disk-shaped substrates and substantially rectangular substrates having orientation flats and/or notches.

For the purpose of the present invention, the object of polish may have any diameter. For example, the object of polish may have a diameter between 6 inches and 8 inches and 12 inches or greater than 12 inches.

As described above, this embodiment can effectively avoid the use of slurry containing large diameter particles and hence prevent unexpected scars from being formed on the surface of the object of polish.

[Eighth Embodiment]

An eighth embodiment of polishing apparatus according to the invention is characterized in that it comprises a hermetically sealable primary canister for containing slury and a gas supply means for supplying gas into the canister. Otherwise, this embodiment is identical with the first through third embodiments.

Figure 11:
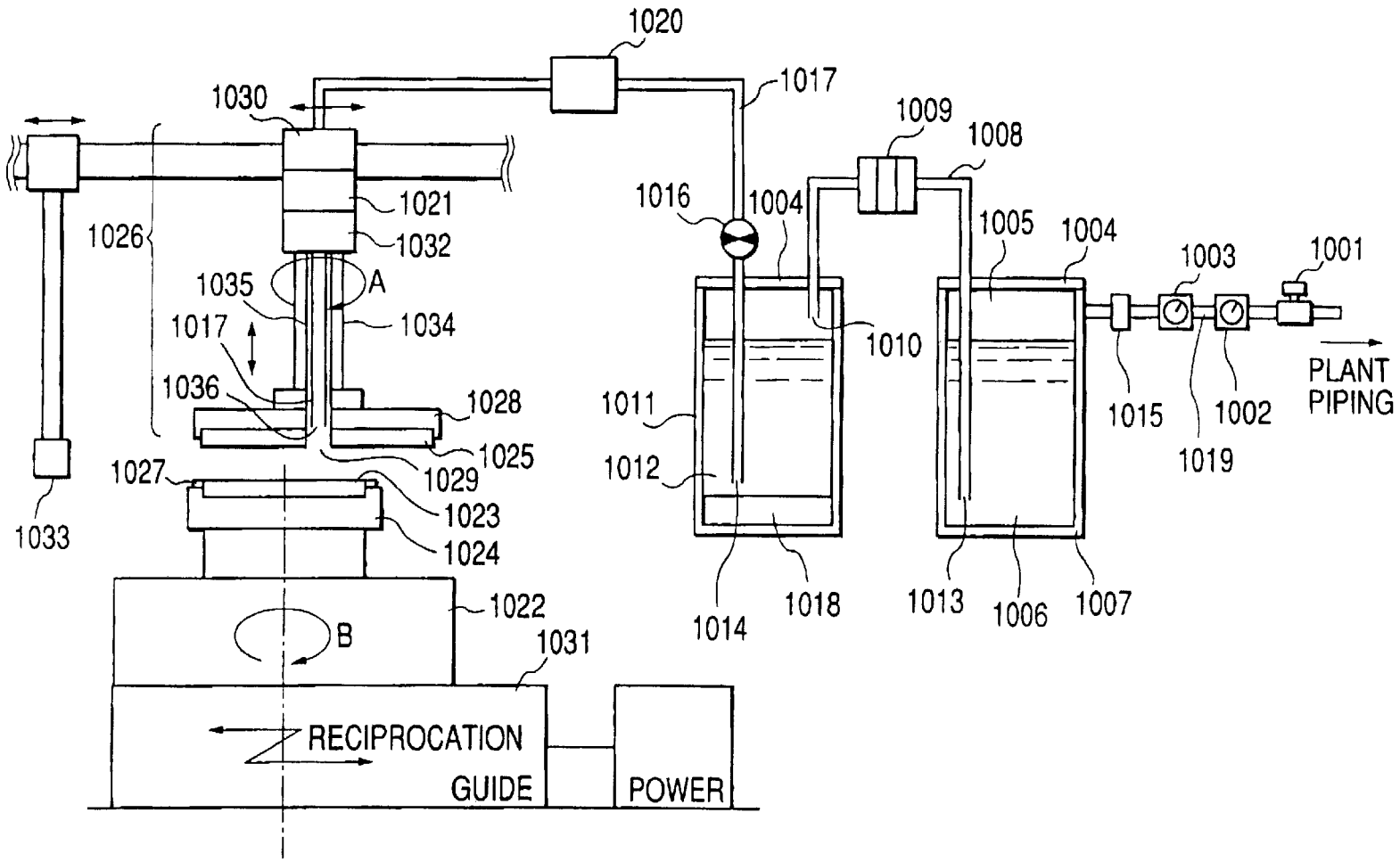
FIG. 11 is a schematic illustration of an eighth embodiment of a polishing apparatus according to the invention.

As shown in FIG. 11, the eighth embodiment of polishing apparatus comprises a primary canister 1005 for containing slurry 1006 and a gas supply means connected to the primary canister 1005 to supply the latter with gas under pressure.

The gas supply means comprises a tube 1019, a filter 1015, a flow meter 1003, a pressure gauge 1002 and a regulator 1001. The tube 1019 is connected to the plant piping (not shown). The flow meter 1003 and the pressure gauge 1002 are used to respectively monitor the flow rate and the pressure of the gas being supplied from the plant piping to the tube 1019 and the regulator 1001 is used to control the flow rate and the pressure of the gas according to the readings of the flow meter 1003 and the pressure gauge 1002. The filter 1015 is arranged midway of the tube 1019 and used to produce dirt-free clean gas out of the gas supplied from the plant piping and supply it into the primary canister 1005.

Gas that can be used for this embodiment may be ordinary air or inert gas such as nitrogen gas or argon gas. The filter may be a porous filter or a filter comprising a dust collector electrode.

The primary canister 1005 can be hermetically sealed by means of a closure 1004. As a result, the slurry 1006 contained therein can be protected against external dirt trying to enter. Additionally, the gas supplied into the primary canister 1005 raises the internal pressure of the primary canister 1005 and encourages the slurry 1006 in the primary canister 1005 to be positively transferred to the secondary canister 1011 by way of the tube 1008.

The outlet 1010 of the tube 1008 is located in an upper part of the secondary canister 1011 along with the vibration generating means 1018 for encouraging particles in the slurry 1012 to reaggregate, the closure 1004 for hermetically sealing the secondary canister 1011, the tube 1017 for feeding slurry 1012 to the polishing head and the valve 1016 of the tube 1017.

The vibration generating means 1018 vibrates the slurry 1012 in the secondary canister 1011 to such an extent that particles in the slurry 1012 are encouraged to contact each other frequently by using an appropriate amplitude and an appropriate frequency, which may be varied. This arrangement can reduce the time required for fine particles to reaggregate.

As slurry 1012 is transferred from the primary canister 1005 to the secondary canister 1011, the volume of the slurry 1012 in the secondary canister 1011 increases. When the valve 1016 is closed, the volume of the gas contained in the secondary canister 1011 is compressed to reduce its volume and raise its pressure. Then, as the valve 1016 is opened, the slurry 1012 in the secondary canister 1011 is forced to move into the inlet 1014 and further to the object of polish by way of the tube 1017 under the raised gas pressure. The flow rate of slurry 1012 can be controlled by regulating the opening of the valve 1016.

The tube 1017 is provided with a filter 1020 for removing large particles that can produce unexpected scars on the surface of the object of polish 1023 out of the slurry 1012 being fed to the object of polish 1023. The particles contained in the slurry 1012 being fed to the object of polish 1023 have a diameter between 0.2 and 0.6 $\mu$m.

The tube 1017 is arranged in the slurry feed path 1035 running along the central axis 1034 of the polishing head 1026 and slurry can be fed to the object of polish through a small aperture 1029.

Now, the polishing head 1026 and the object-of-polish-holding means 1024 of this embodiment will be described below. The polishing head 1026 has a second drive means 1021 and is driven to revolve in the direction indicated by arrow A. The polishing head 1026 also has a platen 1028 for holding a polishing pad 1025, which platen 1028 has a small aperture 1029. The small aperture 1029 operates as aperture of the slurry feed path 1035 at the platen 1028. The tube 1017 is arranged in the slurry feed path 1035 and the outlet 1036 of the tube 1017 is located close to the small aperture 1029 so that slurry can be discharged directly onto the object of polish from the small aperture 1029 by way of the polishing pad 1025.

An anti-twist means (not shown) such as a bearing is arranged between the tube 1017 and the slurry feed path 1035 so that the tube 1017 is prevented from being twisted by the movement of the polishing head 1026 that is revolving around the axis.

The polishing head 1026 can hold the polishing pad 1025 by means of the platen 1028. The polishing pad 1025 is a relatively hard elastic member typically made of polyurethane and its polishing surface has fine pores of several to several hundreds of $\mu$m.

The polishing pad 1025 held by the polishing head 1026 has a diameter greater than that of the object of polish 1023 but not greater than the twice of the diameter of the object of polish 1023.

The polishing head 1026 can move horizontally by a first drive means 1030 and move vertically by a fourth drive means 1032, which is the means for bringing the object of polish and the polishing head into mutual abutment. Thus, the polishing head 1026 and the object of polish 1023 held by the object-of-polish-holding means 1024 are made to abut each other in such a way that their centers are not aligned with each other. The object of polish 1023 is held by the object-of-polish-holding means 1024 with the surface to be polished facing upward.

More specifically, they are positioned in such a way that sum of the distance between the center of the polishing pad 1025 and that of the object of polish 1023 and the radius of the object of polish 1023 is not smaller than the radius of the polishing pad 1025. During the polishing operation, the surface, to be polished, of the object of polish is entirely covered by the polishing pad 1025.

The pressure under which the polishing pad 1025 abuts the object of polish 1023 is controlled by a pressure control means (not shown) arranged at the polishing head 1026.

The object-of-polish-holding means 1024 has a backing film (not shown) typically made of polyurethane and rigidly holds the rear surface of the object of polish 1023 opposite to the surface to be polished. The object-of-polish-holding means 1024 additionally has a substantially annular guide ring 1027 for peripherally holding the object of polish 1023 and preventing the latter from being laterally shifted.

The object-of-polish-holding means 1024 has a third drive means 1022 and is driven to revolve in the direction indicated by arrow B in FIG. 11, which is same as the direction in which the polishing head revolves.

The object of polish 1023 is a semiconductor wafer carrying a material for forming semiconductor elements on the surface to be polished and having a diameter of 8 inches.

Both the polishing head 1026 and the object-of-polish-holding means 1024 may be driven to rotate at a rate of several tens of rpm to several tens of thousands of rpm. They may be made to revolve at a same rate or at respective rates that are different from each other by several rmp.

The object-of-polish-holding means 1024 may be made to reciprocate horizontally during the polishing operation by means of a fifth drive means 1031. The amplitude of the reciprocating motion is between several millimeters and several tens of millimeters and the frequency of reciprocation is several times to several tens of times per second.

As described above, with this embodiment of polishing apparatus, slurry can be directly and efficiently fed to the surface, to be polished, of the object of polish 1023 from the small aperture 1029 of the platen 1028. Additionally, since slurry can be fed to the inside of the surface to be polished with this embodiment of polishing apparatus, the debris produced by the polishing operation can be delivered to the outside with the waste of slurry.

With this embodiment of polishing apparatus, the polishing pad 1025 has a diameter not smaller than the diameter of the object of polish 1023 but not greater than the twice of the diameter of the object of polish 1023. Therefore, if the object of polish 1023 has a diameter of 8 inches, the diameter of the polishing pad 1025 will be less than 16 inches at maximum, and if, on the other hand, the object of polish 1023 has a diameter of 12 inches, the diameter of the polishing pad 1025 will be 24 inches at maximum. Thus, it will be appreciated that the polishing pad 1025 can be driven to rotate at high speed. When the number of revolutions per unit time of the polishing pad 1025 is made equal to that of the object of polish 1023 and they are driven in a same direction, the object of polish 1023 is made to show a same and identical rotary speed at any point on the surface to be polished so that the object of polish 1023 can be polished evenly and uniformly over the entire surface thereof.

This embodiment of polishing apparatus is also provided with a detector 1033 for observing the surface, being polished, of the object of polish 1023. When the polishing pad 1025 is not entirely covering the object of polish 1023, the detector 1033 is moved to a position directly above the object of polish 1023 to observe the surface, being polished, of the object of polish 1023.

The detector 1033 irradiates the surface being polished with a laser beam of a beam of white light and determines the profile of the surface being polished and the thickness of the surface film layer on the basis of the reflected beam it received. An image of the surface can be taken, enlarged and visually observed.

Additionally, the data obtained by the detector 1033 may be sent to an information processing system (not shown) and utilized when selecting polishing conditions for another object of polish. For example, they may be used for determining the timing of terminating the operation of polishing each wafer and/or for polishing the succeeding object of polishs more uniformly if a large number of object of polishs are being polished continuously.

Now, the diametric distribution of the particles contained in the primary canister, that of the particles fed to the secondary canister 1011 by way of the filter unit and that of the particles transferred to the tube 1017 from the secondary canister 1011 will be discussed by referring to FIG. 12.

Figure 12:
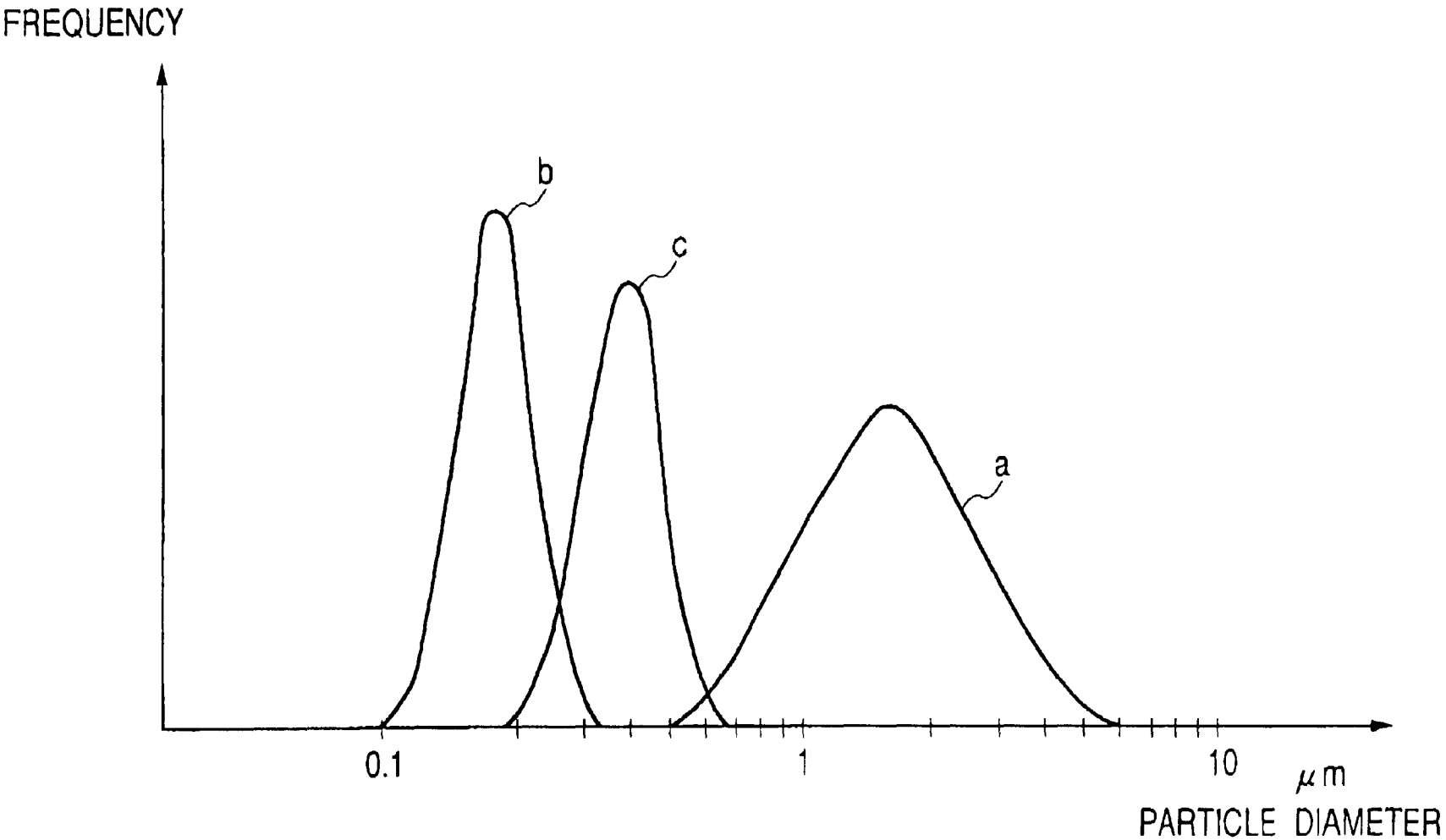
FIG. 12 is a graph illustrating a diametric distribution of particles.

FIG. 12 is a graph schematically illustrating the diametric distribution of particles. In the graph of FIG. 12, the horizontal axis represents the diameter of particles. The diameter increases in the direction indicated by the arrow of the horizontal axis. The vertical axis represents the frequency of appearance of particles of arbitrary diameters. The frequency increases in the direction indicated by the arrow of the horizontal aixs. Curve a in FIG. 12 represents the diametric distribution of the particles in the slurry 1006 contained in the primary canister 1005. As seen from the curve a, the diameter of the particles in the slurry 1006 varies over a wide range. In other words, the particles are not uniformly sized.

Curve b in FIG. 12 represents the diametric distribution of the particles in the slurry 1006 subjected to an ultrasonic wave treatment and subsequently taken up into the tube 1008 through the inlet 1013 so as to be fed to the secondary canister 1011. As seen from the curve b, large particles in the slurry 1006 are fractionized as a result of the ultrasonic wave treatment and the particles are practically of a uniform size.

Curve c in FIG. 12 represents the diametric distribution of the particles in the slurry 1012 taken up from the secondary canister 1011 through the inlet 1014 of the tube 1017. As seen from the curve c, the particles taken up through the inlet 1014 of the tube 1017 are also practically of a uniform size and the average diameter is greater than that of the particles of the curve b, and they do not contain large particles that can produce unexpected scars on the surface of the object of polish.

Thus, since this embodiment of polishing apparatus is adapted to supply gas to the hermetically sealable primary canister, it can effectively prevent particles of dirt in the atmosphere from entering slurry when transferring it to the secondary canister.

Additionally, since the primary canister of this embodiment is hermetically sealable, if the dispersant liquid of the slurry is a mixture of two or more than two substances having different boiling points, the substance having a low boiling point can be prevented from evaporating to keep the composition of the mixture unvaried. Particularly, in view of the fact that the slurry exposed to an ultrasonic wave in the primary canister is apt to show a temperature rise, this embodiment is particularly advantageous in terms of preventing the liquid of slurry from evaporating. For example, this embodiment of polishing apparatus is particularly advantageous when the liquid of slurry is a mixture of water and a low boiling point liquid substance such as isopropyl alcohol.

With this embodiment of polishing apparatus according to the invention, the polishing head 1026 and the object-of-polish-holding means 1024 may be driven to rotate in opposite directions instead of being driving in a same direction as described above. Still alternatively, instead of driving both the polishing head 1026 and the object-of-polish-holding means 1024, it is possible to drive only the polishing head 1026 without rotating the object-of-polish-holding means 1024. Then, the second drive means 1021 for driving the object-of-polish-holding means 1024 is not necessary. Still alternatively, it is possible to drive only the object-of-polish-holding means 1024 without rotating the polishing head 1026.

While the object-of-polish-holding means 1024 of this embodiment of polishing apparatus according to the invention is provided with a fifth drive means 1031 for reciprocating the object of polish 1021 during the polishing operation in the above description, the fifth drive means 1031 may alternatively be arranged at the polishing head 1026 or, still alternatively, both the object-of-polish-holding means 1024 and the polishing head 1026 may be provided with respective reciprocating means.

If the polishing pad 1025 and the object of polish 1023 are driven to rotate at a rate of several tens of rpm to several tens of thousands of rpm, the number of revolutions per minute of the polishing pad 1025 and that of the object of polish 1023 are preferably differentiated by several rpm.

The polishing pad 1025 of this embodiment of polishing apparatus according to the invention may preferably have grooves arranged to a lattice, grooves arranged concentrically or grooves arranged radially on the polishing surface to effectively polish the object of polish 1012 without the risk of transferring the pattern of the groove of the polishing pad 1025 onto the surface, being polished, of the object of polish 1023.

The polishing head 1026 of a polishing apparatus according to the invention may be provided with a drive means (not shown) for driving the polishing pad 1025 to move along an orbit while it is revolving.

In stead of providing the polishing head 1026 with a drive means for driving it to revolve and a drive means (not shown) for driving it to move along an orbit, the object-of-polish-holding means 1024 may be provided with such means. Still alternatively, both the polishing head 1026 and the object-of-polish-holding means 1024 may be provided with such means.

Still alternatively, it may be so arranged that either the polishing head 1026 or the object-of-polish-holding means 1024 is provided with a drive means for driving it along an orbit, while the other is not driven to rotate.

Then, the direction of revolution may be same as or opposite to the direction in which the polishing head 1026 and/or the object-of-polish-holding means 1024 is driven to move along an orbit, although the use of opposite directions is preferable from the viewpoint of high precision polishing.

While the polishing head 1026 and/or the object-of-polish-holding means 1024 may be driven to revolve around its axis and along an orbit with respective numbers of revolutions per unit time that are selected independently, they are preferably differentiated by several rpm from the viewpoint of high precision polishing.

While the polishing head 1026 is located above the object-of-polish-holding means 1024 of a polishing apparatus according to the invention in the above description, the polishing head 1026 may alternatively be located below the object-of-polish-holding means 1024.

With this embodiment of polishing apparatus according to the invention, in addition to feeding slurry through the small aperture 1029 arranged at the polishing head 1026, slurry may additionally be fed by a slurry feed means (not shown) to feed slurry to between the object of polish 1023 and the polishing pad 1025 from the outside of the polishing head 1026.

The polishing pad 1025 a polishing apparatus according to the invention may be provided with a small aperture 1029 that facilitates the supply of slurry through the pores 26 to the object of polish 1023. Alternatively, the polishing pad 1025 may be made of a material that allows slurry to pass therethrough with ease or a material that has large pores such as woven cloth.

The polishing pad 1025 of a polishing apparatus according to the invention may have a diameter smaller than that of the object of polish 1023. If such is the case, it is possible to polish part of the object of polish 1023. Alternatively, the diameter of the polishing pad 1025 may be more than twice of that of the object of polish 1023.

[Ninth Embodiment]

Figure 13:
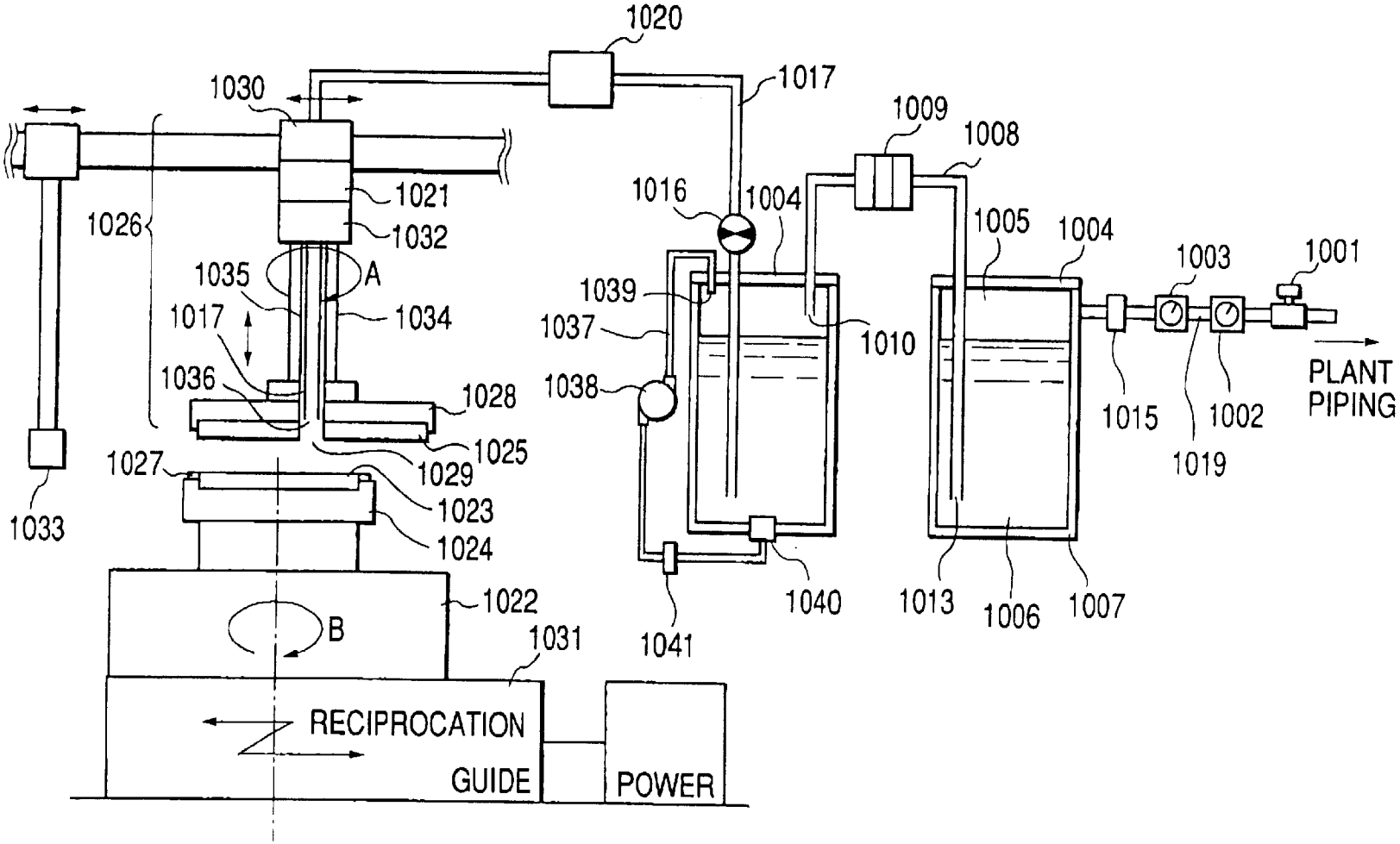
FIG. 13 is a schematic illustration of a ninth embodiment of a polishing apparatus according to the invention.

A ninth embodiment of polishing apparatus according to the invention is characterized in that the secondary canister is provided with a bubble generating means as means for encouraging reaggregation of fine particles as shown in FIG. 13. Otherwise, this embodiment is identical with the eighth embodiment.

As shown information in FIG. 13, the bubble generating means comprises a tube 1037 and a pump 1038.

The suction port 1039 of the tube 1037 is arranged in an upper part of the secondary canister 1011 and the air discharge port 1040 of the tube 1037 is arranged at a position good for feeding the slurry 1012 in the secondary canister 1011 with air bubbles, which is located on the bottom of the secondary canister 1011. The pump 1038 draws gas from the inside of the secondary canister 1011 through the suction port 1039 of the tube 1037 and sends it into the slurry 1012 through the air discharge port 1040. The supplied air moves through the slurry 1012 as bubbles that raise the opportunities in which fine particles can aggregate.

The secondary canister 1011 is provided with a closure 1004 that can hermetically seal the secondary canister 1011 to produce a closed space for storing the slurry 12 within the secondary canister 1011. Thus, the operation of drawing clear air contained in the secondary canister 1011 by the bubble generating means and driving it into the slurry can be repeated to prevent impurity particles from entering the slurry from outside.

Additionally, a filter 1041 is arranged on the tube between the pump 1038 and the air discharge port 1040 to remove large particles that may be contained in the slurry at a low concentration level. Then, the air can be held in a clean condition for a prolonged period of time.

Since the secondary canister 1011 of this embodiment can be hermetically sealed by a closure, the slurry in the canister 1011 is prevented from evaporating and reducing its volume as a result of the bubbling operation. Thus, the effect of slurry can be maintained for a long period of time if the bubbling operation is continued.

[Tenth Embodiment]

Figure 14:
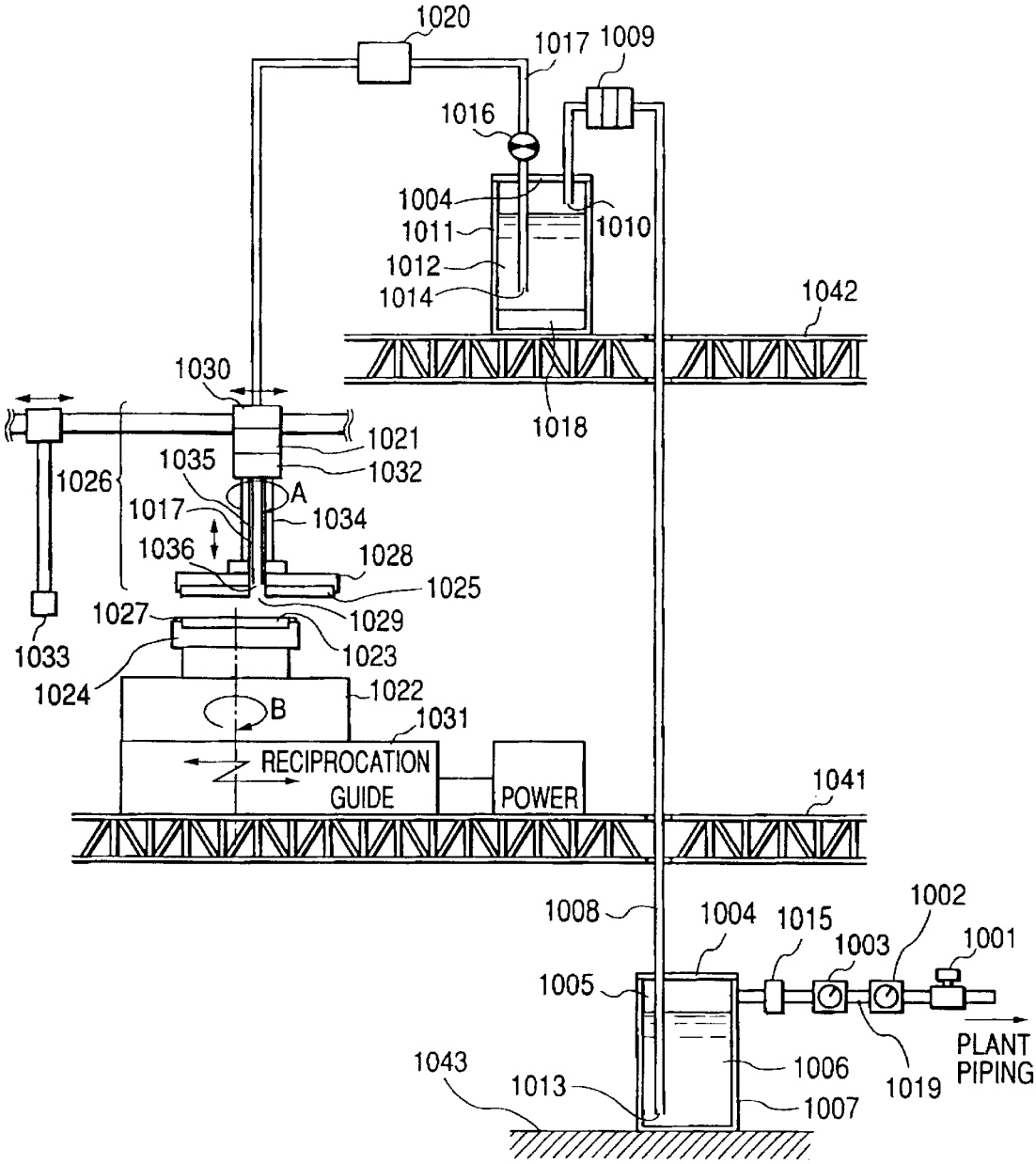
FIG. 14 is a schematic illustration of a tenth embodiment of a polishing apparatus according to the invention.

A tenth embodiment of polishing apparatus according to the invention is characterized in that the inlet 1014 of the tube 1017 is located above the outlet 1036 and the primary canister is arranged below the floor supporting the polishing head and the object-of-polish-holding means as shown in FIG. 14. Otherwise, this embodiment is identical with the eighth embodiment.

FIG. 14 is a schematic illustration of this embodiment of polishing apparatus as installed in a clean room where clean air is made to flow downwardly from above and from floor 1042 to floor 1043 by way of floor 1041.

Referring to FIG. 14, the secondary canister 1011 is arranged on the floor 1042 located above the floor 1041 for supporting the polishing head 1026 and the object-of-polish-holding means 1024. The tube 1008 extends from the floor 1043 where the primary canister 1007 is arranged to the floor 1042 where the secondary canister 1011 is arranged through the floor 1041 supporting the polishing head 1026 and the object-of-polish-holding means 1024. The filter 1009 is located at a position close to the output 1010 of the tube 1008.

Since the inlet 1014 of the tube 1017 is located above the outlet 1036, slurry 1012 can easily by transferred from the secondary canister 1011 to the outlet 1036 if the secondary canister 1011 is opened to make its internal pressure equal to the atmospheric pressure.

The primary canister 1007 is arranged on the floor 1043 located below the floor 1041 supporting the polishing head 1026 and the object-of-polish-holding means 1024. As a result, any vibrations that may be produced by ultrasonic wave generating means and/or the gas supply means are prevented from being transmitted to the floor 1041 carrying the polishing head 1026 and the object-of-polish-holding means 1024.

Additionally, since the primary canister 1007 is hermetically sealed, no dirt will be allowed to enter the slurry contained in it from outside. Therefore, the polishing head and the object-of-polish-holding means can be arranged on the floor 1043 located below the floor 1041 supporting the polishing head and the object-of-polish-holding means and hence downstream relative to the clean room.

In this tenth embodiment, the vibration generating means arranged at the secondary canister 1011 may be replaced by a bubble generating means as described above by referring to the ninth embodiment.

This embodiment may additionally be provided with a pump (not shown) so that slurry 1006 may be transferred easily and forcibly from the primary canister 1007 arranged on the bottom floor to the secondary canister 1011 arranged on the upper floor by way of the tube 1008. If such is the case, the filter 1009 is preferably located at a position closer to the secondary canister 1011 relative to the pump so that large particles may be removed from the slurry 1006 being transferred by the pump.

[Eleventh Embodiment]

Figure 15:
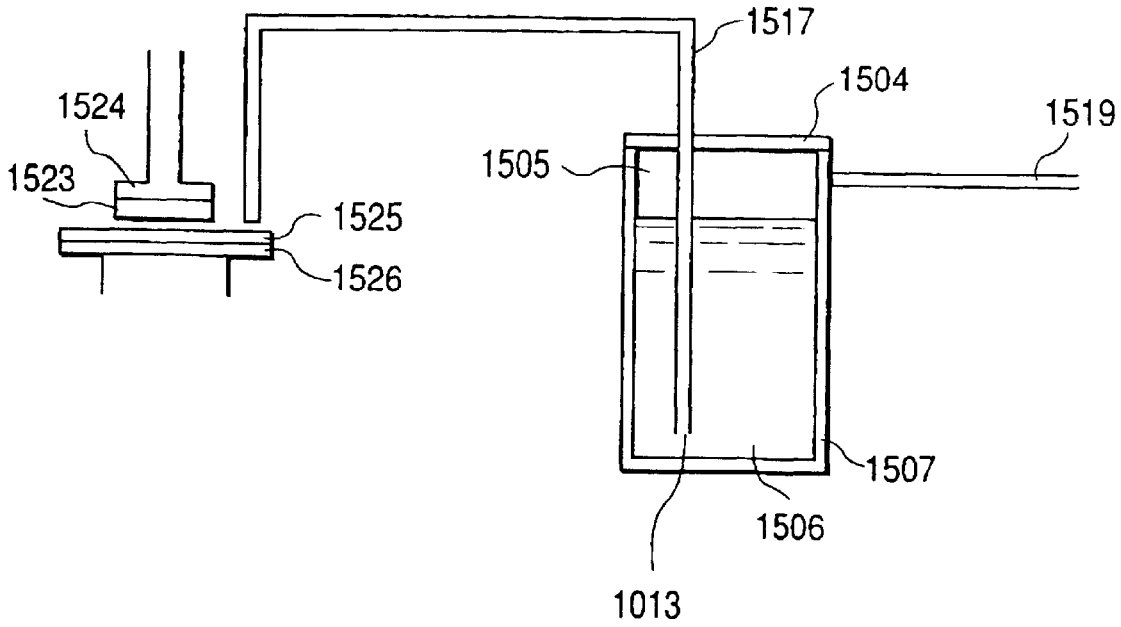
FIG. 15 is a schematic illustration of an eleventh embodiment of a polishing apparatus according to the invention.

An eleventh embodiment of polishing apparatus according to the invention is characterized by comprising a object-of-polish-holding means 1524 for holding an object of polish 1523, a polishing head 1526, a hermetically sealable canister 1505 (container) for containing slurry 1506, a tube 1519 (gas supply means) for supplying gas into the canister 1505 and a tube 1517 (feed pipe) for feeding slurry 1506 from the canister 1505 to the object of polish 1523 as shown in FIG. 15.

Slurry 1506 as used herein refers to a substance where particles of silicon oxide are stably dispersed in liquid. The liquid is a mixture solution of water and isopropyl alcohol. Additionally, potassium hydroxide is dissolved in slurry 1506 as an agent for dispersing fine particles. The term dispersion as used herein refers to state where dispersed particles are held in a stable state.

Referring to FIG. 15, the canister 1505 can be hermetically sealed by means of a closure 1504. Additionally, the canister 1505 is provided with a tube 1519 adapted to supply gas into the canister 1505. The gas supplied by the tube 1519 is nitrogen.

Still additionally, the canister 1505 is provided with a feed pipe 1517 for feeding slurry 1506 to the object of polish 1523. As gas is supplied from the tube 1519 into the canister 1505 hermetically sealed by the closure 1504, the internal pressure of the canister 1505 is raised to force the slurry 1506 in the canister 1505 to move to the object of polish 1523 by way of the inlet 1513 of the feed pipe 1517. As slurry is fed, the object of polish 1523 is made to abut on the polishing pad 1525 removably held to the polishing head 1526 and polished.

With this embodiment, since a large volume of slurry 1506 can be contained in the canister without exposing it to the atmosphere, it can prevents large diameter particles from entering the slurry 1506 from the atmosphere. Therefore, slurry containing no large particles can be fed to the object of polish 1523 for a prolonged period of time.

With this embodiment, since a large volume of slurry 1506 can be contained in the canister without exposing it to the atmosphere, it can prevent the slurry 1506 from evaporating to consequently reduce its volume; and, if the solvent is a mixture of two or more than two liquids, it can prevent the slurry 1506 from changing the mixing ratio thereof. Furthermore, the solute concentration of the slurry 1506 can remain unvaried with this embodiment. As a result, particles in the slurry are prevented from aggregating to become large particles so that slurry can be supplied to the object of polish for a prolonged period of time.

While nitrogen is used as gas in the above description, it may be replaced by other inert gas such as argon or air.

Slurry as used for this embodiment contains particles of manganese oxide, silicon oxide, cerium oxide, aluminum oxide, zeolite oxide, chromium oxide, iron oxide, silicon carbide, boron carbide, carbon or ammonium salt having a uniform size of several millimeters to sub-microns and dispersed in an aqueous solution of sodium hydroxide, potassium hydroxide, ammonium, isocyanuric acid, Br—$CH_3OH$, isopropyl alcohol or hydrochloric acid or pure water. Any appropriate combination of the material of particles and the type of aqueous solution may be used according to the type of the object of polish. For example, a polishing agent prepared by dispersing fine particles of silicon oxide, cerium oxide, ammonium salt or manganese dioxide into a solution may suitably be used for polishing the surface of an Si wafer, and a polishing agent prepared by dispersing fine particles of silicon oxide into an aqueous solution of potassium hydroxide may suitably be used for polishing the surface of an $SiO_2$ wafer, whereas a polishing agent prepared by dispersing fine particles of silicon oxide into an aqueous solution of ammonium containing hydrogen peroxide may suitably be used for polishing the surface of an Al wafer. Objects of polish that can be polished by this embodiment of polishing apparatus include semiconductor wafers such as those containing silicon and/or Ga/As and wafers containing at least a material for forming semiconductor elements such as transistors. Other objects of polish that can be polished by this embodiment include SOI substrates and display substrates as well as substantially disk-shaped substrates and substantially rectangular substrates having orientation flats and/or notches.

For the purpose of the present invention, the object of polish may have any diameter. For example, the object of polish may have a diameter between 6 inches and 8 inches and 12 inches or greater than 12 inches.

As described above, this embodiment can effectively avoid the use of slurry containing large diameter particles and hence prevent unexpected scars from being formed on the surface of the object of polish.

[Twelfth Embodiment]

A twelfth embodiment of polishing apparatus according to the invention is characterized in that a hermetically sealable canister is arranged in a space whose pressure is lower than the atmospheric pressure. Otherwise, this embodiment is identical with the eleventh embodiment.

Figure 16:
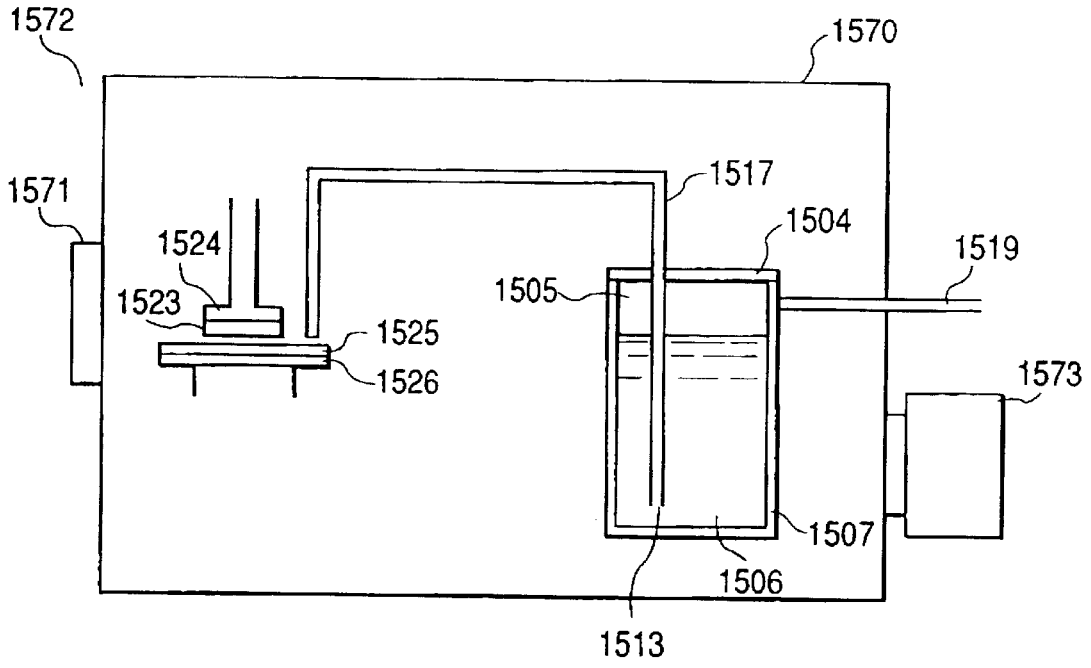
FIG. 16 is a schematic illustration of a twelfth embodiment of a polishing apparatus according to the invention.

FIG. 16 is a schematic illustration of this embodiment of a polishing apparatus. The polishing apparatus comprises a bulkhead 1570 and is arranged in a clean room 1572. An exhaust means 1573 is arranged on the bulkhead 1570, so that the pressure of the inside enclosed by the bulkhead 1570 can be held to a level lower than that of the clean room 1572.

Note, however, that the pressure of the inside enclosed by the bulkhead 1570 is only slightly lower than the atmospheric pressure.

The inside enclosed by the bulkhead 1570 contains therein an object-of-polish-holding means 1524, a polishing head 1525, a hermetically sealable canister 1507 and tubes 1517, 1519.

The inside enclosed by the bulkhead 1570 is provided with a doorway 1571. The doorway 1571 is provided with a closing means such as door for isolating the inside enclosed by the bulkhead 1570 from the clean room 1572. Thus, an object of polish 1523 can be brought into and out from the polishing apparatus through the doorway 1571.

Since this embodiment of polishing apparatus comprises the bulkhead 1570, any debris and evaporated solvent of slurry 1506 produced as a result of polishing operation are prevented from leaking out into the clean room 1572.

Additionally, this embodiment of polishing apparatus comprises an exhaust means 1573 that positively prevents any debris and evaporated solvent of slurry 1506 produced as a result of polishing operation from leaking out into the clean room 1572.

The canister 1505 can be hermetically sealed. Therefore, if it is arranged in a low pressure space, it can prevent the solvent of slurry 1506 from evaporating. Additionally, it can also prevent debris produced as a result of polishing operation from entering the slurry 1506.

While the doorway 1571 of this embodiment of polishing apparatus is provided with a closing means such as door in the above description, it may be omitted if debris and evaporated solvent of slurry 1506 produced as a result of polishing operation are prevented from leaking out into the clean room 1572 without using such means. Alternatively, the doorway may be replaced by a load-lock chamber for completely isolating the space containing the polishing head from the clean room.

Additionally, this embodiment of polishing apparatus may by provided with a collecting means for collecting any debris and evaporated solvent of slurry 1506 produced as a result of polishing operation.

[Thirteenth Embodiment]

A thirteenth embodiment of polishing apparatus according to the invention is characterized by comprising an object-of-polish-holding means for holding an object of polish, a polishing head, a first container for containing slurry (primary canister), a fractionizing means for fractionizing particulate aggregates into small particles arranged at the first container, a gas supply means for supplying gas to the first container, a transfer pipe (tube) for transferring slurry from the first container to a second container (secondary canister) and a feed pipe (tube) for supplying slurry from the second container to the object of polish. Otherwise, this embodiment is identical with the first and second embodiments.

Figure 17:
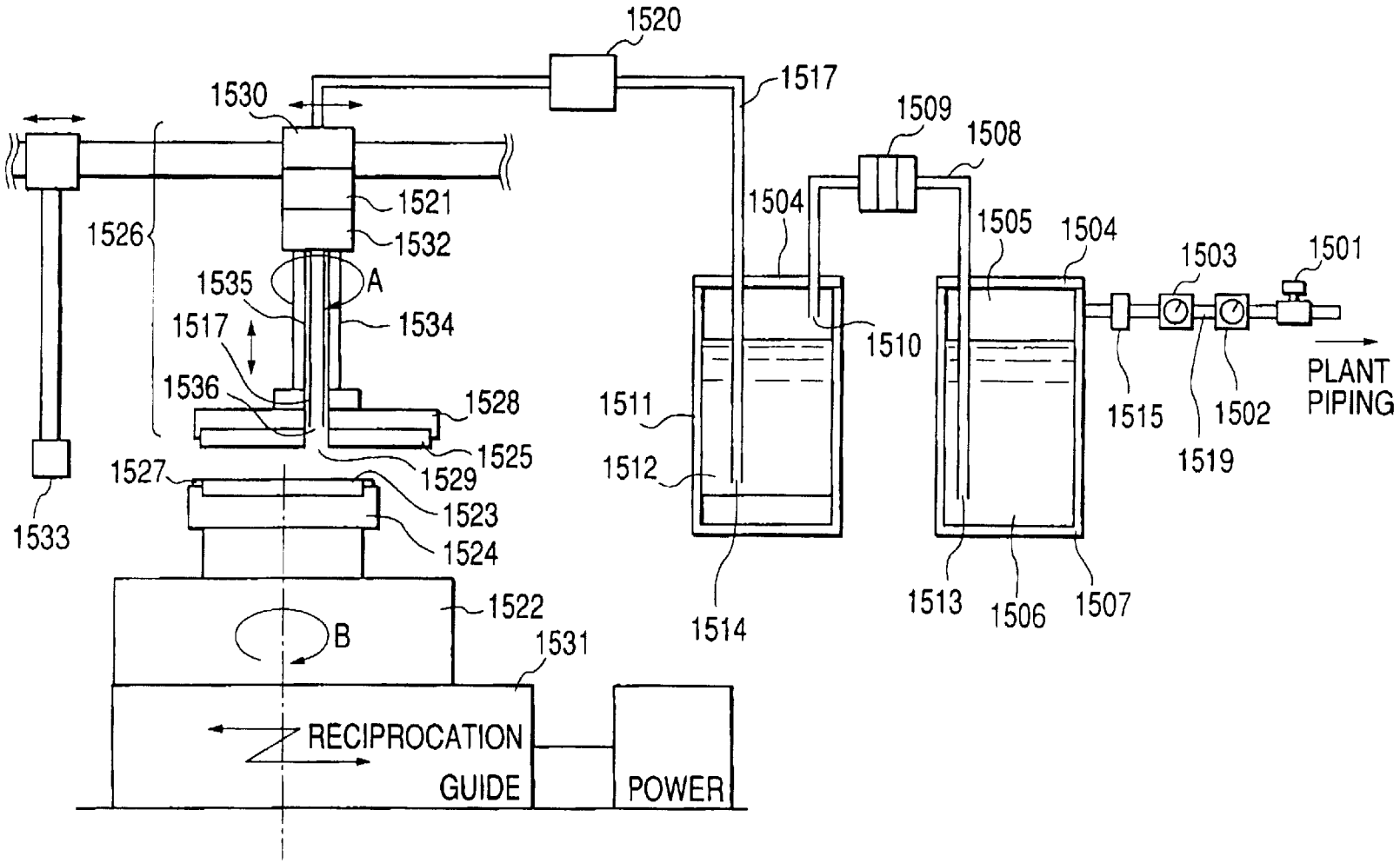
FIG. 17 is a schematic illustration of a thirteenth embodiment of a polishing apparatus according to the invention.

FIG. 17 schematically illustrates this embodiment of polishing apparatus. Reerring to FIG. 17, the embodiment comprises an object-of-polish-holding means 1524 for holding an object of polish 1523, a polishing head 1525, a primary canister 1505 for containing slurry 1506 and a secondary canister 1511 that is a container separated from the primary canister 1505.

Additionally, it comprises a transfer pipe (tube) 1508 arranged between the primary canister 1505 and the secondary canister 1511 in order to transfer slurry 1506 from the primary canister 1505 to the secondary canister 1511.

The gas supply means comprises a tube 1511, a filter unit 1515, a flow meter 1503, a pressure gauge 1502 and a regulator 1501. The tube 1519 is connected to the plant piping (not shown). The flow meter 1503 and the pressure gauge 1502 are used to respectively monitor the flow rate and the pressure of the gas being supplied from the plant piping to the tube 1519, and the regulator 1501 is used to control the flow rate and the pressure of the gas according to the readings of the flow meter 1503 and the pressure gauge 1502. The filter 1515 is arranged midway of the tube 1519 and used to produce dirt-free clean gas out of the gas supplied from the plant piping and supply it into the primary canister 1505. Gas that can be used for this embodiment may be ordinary air or gas such as nitrogen gas not containing oxygen. The filter may be a porous filter or a filter comprising a dust collector electrode.

Slurry 1506 as used for this embodiment is obtained by dispersing polishing particles of dimanganese trioxide into neutral water. The particles have a diameter that can vary within a wide range extending from 0.5 to 5 $\mu$m and include particulate aggregates to a large extent. Particles of dimanganese trioxide is pooly dispersing in neural liquid and, if dispersed, they quickly reaggregate and precipitate in a short period of time.

The primary canister 1505 is provided with a fractionizing means for fractonizing particulate aggregates into fine particles. The fractionizing means is an ultrasonic wave generating means 1507 for tramsitting an ultrasonic wave to particulate aggregates and fractionize them into fine particles.

The tub 1508 is arranged between the primary canister 1505 and the secondary canister 1511 to transfer slurry 1506 from the primary canister 1505 to the secondary canister 1511. The inlet 1513 of the tube 1508 is located at a level slightly higher than the level to which the precipitate of large particles including particulate aggregates can be concentrated. Therefore, fractionized fine particles can be selectively taken up through the inlet 1513.

The filter unit 1509 is arranged at the tube 1508. The filter unit 1509 comprises three filters having three different respective pore sizes (pore diameters). More specifically, they are 1 $\mu$m, 0.5 $\mu$m and 0.2 $\mu$m filters arranged in the descending order as viewed from the primary canister 1505 toward the secondary canister 1511. With this arrangement, large particles entering the tube 1508 through the inlet 1513 can be filtered out so that slurry 1506 is moved into the secondary canister 1511 without large particles. The filters are made of polytetrafluoroethylene, cellulose, ceramic or stainless steel. As a result of filtration, the slurry 1506 will contain uniformly dispersed particles showing a diameter of about 0.1 to 0.3 $\mu$m when observed immediately after the filtering operation.

The outlet 1510 of the tube 1508 is located in an upper part of the secondary canister 1511 so that the slurry fed from the primary 1505 is discharged onto the surface of the slurry 1512 contained in the secondary canister 1511 from above.

On the other hand, the second canister 1511 is adapted to make fine particles in the slurry 1512 reaggregate and grow to show a diameter appropriate for polishing operations while they are staying in the secondary canister 1511. The diameter of particles that can appropriately be used for polishing an object of polish is within a range between 0.2 and 0.6 $\mu$m. Such particles are smaller than particles that can give unexpected scars on the object of polish.

The secondary canister 1511 is provided with a tube 1517 for transferring slurry 1512 from the secondary canister 1511 to the object of polish 1523. The inlet 1514 of the tube 1517 is located at a lower part of the secondary canister 1511 so that it can not only easily collect precipitated particulate aggregates from the bottom but also take up the last drop of slurry 1512 from the secondary canister 1511. Like the primary canister 1507, the secondary canister 1511 is provided with a closure 1504 to hermetically seal it. With this arrangement, slurry 1512 can be fed to the object of polish 1523 by utilizing the pressure of the slurry 1506 fed from the primary canister 1507.

The tube 1517 is provided with a filter 1520 for ultimately removing large particles that can produce unexpected scars on the surface of the object of polish 1523 out of the slurry 1512 being fed to the object of polish 1523.

As described above, with this embodiment, a large volume of particulate aggregates can be fractionized into fine paritcles by the fractionizing means arranged at the first container. Therefore, slurry containing large particles to a large extent no longer needs to be additionally treated to remove large particles and the quality of slurry can be maintained for use in an effective way. Additionally, the primary canister can be hermetically sealed by means of a closure, and the slurry can be transferred to the secondary canister by way of the transfer pipe by supplying compressed gas to the primary canister. As a result, the slurry contained therein can be protected against external dirt trying to enter. Furthermore, in view of the fact that the slurry exposed to an ultrasonic wave is apt to show a temperature rise, this embodiment is particularly advantageous in terms of preventing the liquid of slurry from evaporating.

The construction and movement of the polishing head and the object-of-polish-holding means in the polishing apparatus of the embodiment shown in FIG. 17 will be described hereinafter.

The object-of-polish-holding means can hold an object of polish 1523 so as to make its surface to be polished face upward. Then, the polishing head 1526 having a removable polishing pad 1525 faces its polishing surface downward.

The tube 1517 is arranged in the slurry feed path 1535 running along the central axis 1534 of the polishing head 1526. The polishing head 1526 has a platen 1528 for holding a polishing pad 1525, which platen 1528 has a small aperture 1529. The small aperture 1529 operates as aperture of the slurry feed path 1535 at the platen 1528. The tube 1517 is arranged in the slurry feed path 1535 and the outlet 1536 of the tube 1517 is located close to the small aperture 1529 so that slurry can be discharged onto the object of polish from the small aperture 1529 by way of the polishing pad 1525. An anti-twist means (not shown) such as a bearing is arranged between the tube 1517 and the slurry feed path 1535 so that the tube 1517 is prevented from being twisted by the movement of the polishing head 1526 that is revolving around the axis.

The polishing head 1526 has the platen 1528 which holds the polishing pad 1525. The platen 1528 has the small aperture 29. The polishing pad 1525 is a relatively hard resilient member typically made of polyurethane and its polishing surface has fine pores of several to several hundreds of $\mu$m.

The object-of-polish-holding means 1524 of this embodiment is adapted to hold an object of polish 1523 with its surface to be polished facing upward.

The object-of-polish-holding means 1524 has a backing film (not shown) typically made of polyurethane and rigidly holds the rear surface of the object of polish 1523 opposite to the surface to be polished. The object-of-polish-holding means 1524 additionally has a substantially annular guide ring 1527 for peripherally holding the object of polish 1523 and preventing the latter from being laterally shifted.

The object of polish 1523 is typically a semiconductor wafer carrying a material for forming semiconductor elements on the surface to be polished and has a diameter of 8 inches.

The polishing pad 1525 held by the polishing head 1526 has a diameter greater than that of the object of polish 1523 but not greater than the twice of the diameter of the object of polish 1523.

The polishing head 1526 and the object-of-polish-holding means 1524 are provided with second and third drive means 1521, 1522 that are adapted to revolve in respective directions indicated by arrows A and B. Thus, the polishing pad 1525 held by the polishing head 1526 and the object of polish 1523 held by the object-of-polish-holding means 1524 revolve in a same direction.

The polishing head 1526 and the object-of-polish-holding means 1524 may be driven to revolve around its axis at a same rate or at respective rates differentiated by several rpm within a range between several rpm and several tens of thousands of rpm.

The polishing head 1526 is driven to move vertically up and down by a fourth drive means 1532 that is an abutment means so that the polishing pad 1525 can be brought into abutment with the object of polish 1523. The pressure applied to the object of polish 1523 by the polishing pad 1525 abutting the former can be controlled by a control means (not shown).

As pointed out above, the platen 1528 of the polishing head 1526 has a small aperture 1529 so that slurry can be evenly supplied to the surface, to be polished, of the object of polish 27 held in abutment with the polishing pad 1525 by way of the smaller aperture. Additionally, since slurry can be continuously supplied to between the polishing pad 1525 and the object of polish 1523, the debris produced by the polishing operation can be delivered to the outside with the waste of slurry.

The object-of-polish-holding means 1524 is provided with a fifth drive means 1531 and can be reciprocated (reciprocatingly moved) horizontally during the polishing operation. The amplitude of the reciprocating motion is between several millimeters and several tens of millimeters and the frequency of reciprocation is several times to several tens of times per second.

The polishing head 1526 is provided with a first drive means 1530. The polishing head 1526 is driven to move by the first drive means 1530 so that the polishing pad 1525 and the object of polish 1523 may be positioned in such a way that their centers are not aligned with each other. More specifically, they are positioned in such a way that sum of the distance between the center of the polishing pad 1525 and that of the object of polish 1523 and the radius of the object of polish 1523 is not smaller than the radius of the polishing pad 1525. During the polishing operation, the surface, to be polished, of the object of polish is entirely covered by the polishing pad 1525.

As pointed out above, the polishing pad 1525 has a diameter not smaller than the diameter of the object of polish 1523 but not greater than the twice of the diameter of the object of polish 1523. Therefore, if the object of polish 1523 has a diameter of 8 inches, the diameter of the polishing pad 1525 will be less than 16 inches at maximum and if, on the other hand, the object of polish 1523 has a diameter of 12 inches, the diameter of the polishing pad 1525 will be 24 inches at maximum. Thus, it will be appreciated that the polishing pad 1525 can be driven to rotate at high speed. When the number of revolutions per unit time of the polishing pad 1525 is made equal to that of the object of polish 1523 and they are driven in a same direction, the object of polish 1523 is made to show a same and identical rotary speed at any point on the surface to be polished so that the object of polish 1523 can be polished evenly and uniformly over the entire surface thereof.

This embodiment of polishing apparatus is also provided with a detector 1533 for observing the surface, being polished, of the object of polish 1523. When the polishing pad 1525 is not entirely covering the object of polish 1523, the detector 1533 is moved to a position directly above the object of polish 1523 to observe the surface, being polished, of the object of polish 1523.

The detector 1533 irradiates the surface, being polished, with a laser beam or a beam of white light and determines the profile of the surface, being polished, and the thickness of the surface film layer on the basis of the reflected beam it received. An image of the surface can be taken, enlarged and visually observed.

Additionally, the data obtained by the detector 1533 may be sent to an information processing system (not shown) and utilized when selecting polishing conditions for other object of polish. For example, they may be used for determining the timing of terminating the operation of polishing each wafer and/or for polishing the succeeding object of polishs more uniformly if a large number of object of polishs are being polished continuously.

Now, the diametric distribution of the particles contained in the primary canister, that of the particles fed to the secondary canister 1511 by way of the filter unit and that of the particles transferred to the tube 1517 from the secondary canister 1511 will be discussed by referring to FIG. 18.

Figure 18:
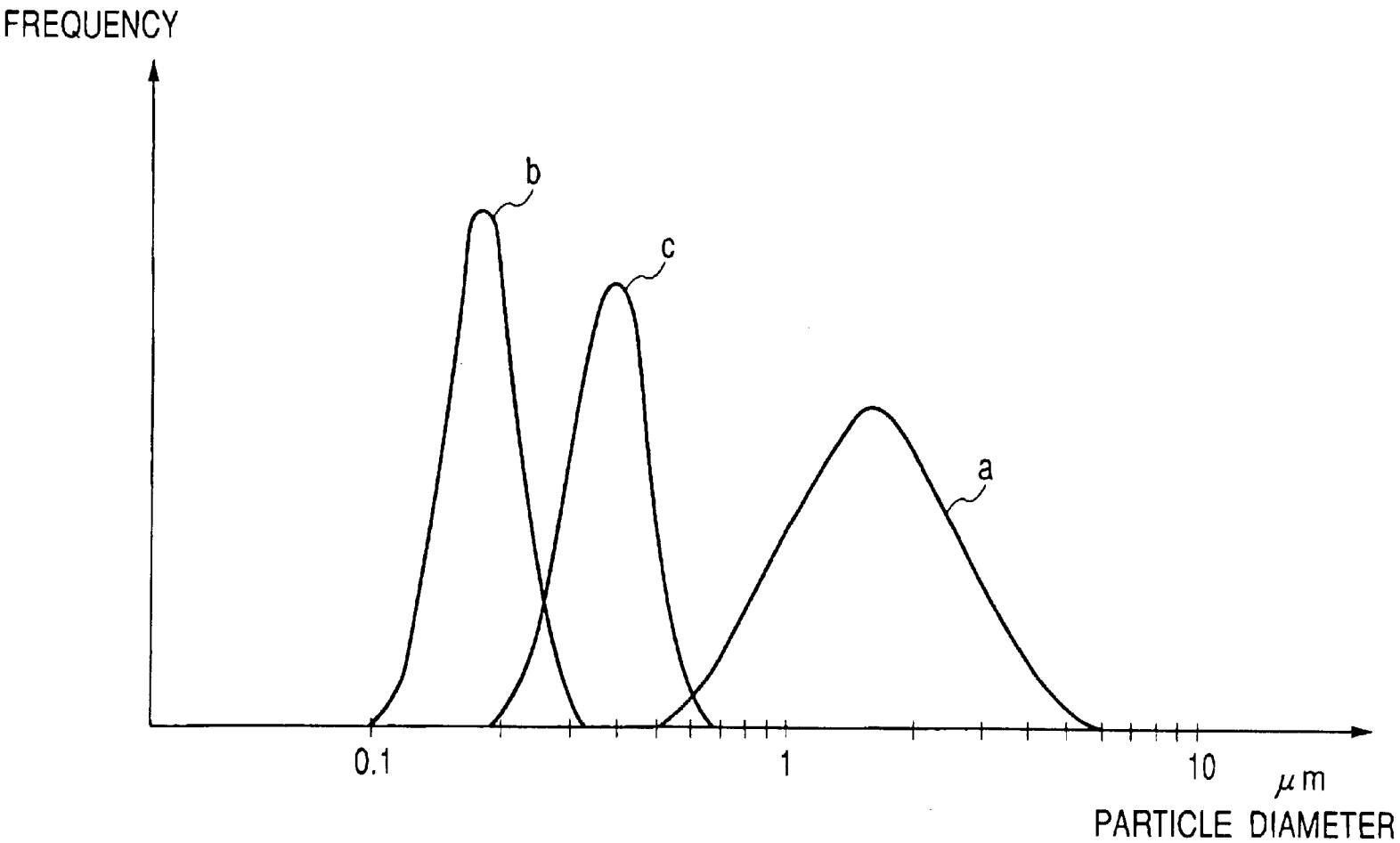
FIG. 18 is a graph illustrating a diametric distribution of particles.

FIG. 18 is a graph schematically illustrating the diametric distribution of particles. In the graph of FIG. 18, the horizontal axis represents the diameter of particles. The diameter increases in the direction indicated by the arrow of the horizontal axis. The vertical axis represents the frequency of appearance of particles of arbitrary diameters. The frequency increases in the direction indicated by the arrow of the horizontal aixs. Curve a in FIG. 18 represents the diametric distribution of the particles in the slurry 1506 contained in the primary canister 1505. As seen from the curve a, the diameter of the particles in the slurry 1506 varies over a wide range. In other words, the particles are not uniformly sized.

Curve b in FIG. 18 represents the diametric distribution of the particles in the slurry 1506 subjected to an ultrasonic wave treatment and subsequently taken up into the tube 1508 through the inlet 1513 so as to be fed to the secondary canister 1511. As seen from the curve b, large particles in the slurry 1506 are fractionized as a result of the ultrasonic wave treatment and the particles are practically of a uniform size.

However, the slurry also contains large particles to a small extent as the latter are taken up through the inlet 1513.

Curve c in FIG. 18 represents the diametric distribution of the particles in the slurry 1512 taken up from the secondary canister 1511 through the inlet 1514 of the tube 1517. As seen from the curve c, the particles taken up through the inlet 1514 of the tube 1517 are also practically of a uniform size and the average diameter is greater than that of the particles of the curve b, and they do not practically contain large particles that can produce unexpected scars on the surface of the object of polish.

With this embodiment, an agitator such as a fan may be used in addition to the ultrasonic wave generating means if such an agitator can fractionize particulate aggregates. However, the use of an ultrasonic wave generating means as described above is particularly advantageous because it can collectively fractionize a large volume of particulate aggregates.

In this embodiment of polishing apparatus, the tube 1517 is preferably provided with a valve (not shown). The internal pressure of the secondary canister 1511 can be regulated by regulating the valve to consequently regulate the flow rate of slurry 1512 being fed to the object of polish 1523.

The embodiment of polishing apparatus may additionally be provided with a pump (not shown) for feeding slurry 1512 from the secondary canister 1511 to the object of polish 1523. Then, the internal pressure of the secondary canister 1511 may be same as the pressure of the ambient air.

With this embodiment of polishing apparatus according to the invention, the polishing head 1526 and the object-of-polish-holding means 1524 may be driven to rotate in opposite directions instead of being driving in a same direction as described above. Still alternatively, instead of driving both the polishing head 1526 and the object-of-polish-holding means 1524, it is possible to drive only the polishing head 1526 without rotating the object-of-polish-holding means 1524. Then, the second drive means 1521 for driving the object-of-polish-holding means 1524 is not necessary. Still alternatively, it is possible to drive only the object-of-polish-holding means 1524 without rotating the polishing head 1526.

While the object-of-polish-holding means 1524 of this embodiment of polishing apparatus according to the invention is provided with a fifth drive means 1531 for reciprocating the object of polish 1521 during the polishing operation in the above description, the fifth drive means 1531 may alternatively be arranged at the polishing head 1526 or, still alternatively, both the object-of-polish-holding means 1524 and the polishing head 1526 may be provided with respective reciprocating means.

If the polishing pad 1525 and the object of polish 1523 are driven to rotate at a rate of several tens of rpm to several tens of thousands of rpm, the number of revolutions per minute of the polishing pad 1525 and that of the object of polish 1523 are preferably differentiated by several rpm.

The polishing pad 1525 of this embodiment of polishing apparatus according to the invention may preferably have grooves arranged to a lattice, grooves arranged concentrically or grooves arranged radially on the polishing surface to effectively polish the object of polish 1512 without the risk of transferring the pattern of the groove of the polishing pad 1525 onto the surface, being polished, of the object of polish 1523.

The polishing head 1526 of a polishing apparatus according to the invention may be provided with a drive means (not shown) for driving the polishing pad 1525 to move along an orbit while it is revolving.

In stead of providing the polishing head 1526 with a drive means for driving it to revolve and a drive means (not shown) for driving it to move along an orbit, the object-of-polish-holding means 1524 may be provided with such means. Still alternatively, both the polishing head 1526 and the object-of-polish-holding means 1524 may be provided with such means.

Still alternatively, it may be so arranged that either the polishing head 1526 or the object-of-polish-holding means 1524 is provided with a drive means for driving it along an orbit, while the other is not driven to rotate.

Then, the direction of revolution may be same as or opposite to the direction in which the polishing head 1526 and/or the object-of-polish-holding means 1524 is driven to move along an orbit, although the use of opposite directions is preferable from the viewpoint of high precision polishing.

While the polishing head 1526 and/or the object-of-polish-holding means 1524 may be driven to revolve around its axis and along an orbit with respective numbers of revolutions per unit time that are selected independently, they are preferably differentiated by several rpm from the viewpoint of high precision polishing.

While the polishing head 1526 is located above the object-of-polish-holding means 1524 of a polishing apparatus according to the invention in the above description, the polishing head 1526 may alternatively be located below the object-of-polish-holding means 1524.

With this embodiment of polishing apparatus according to the invention, in addition to feeding slurry through the small aperture 1529 arranged at the polishing head 1526, slurry may additionally be fed by a slurry feed means (not shown) to feed slurry to between the object of polish 1523 and the polishing pad 1525 from the outside of the polishing head 1526.

The polishing pad 1525 of a polishing apparatus according to the invention may be provided with a small aperture 1529 that facilitates the supply of slurry through the pores 26 to the object of polish 1523. Alternatively, the polishing pad 1525 may be made of a material that allows slurry to pass therethrough with ease or a material that has large pores such as woven cloth.

The polishing pad 1525 of a polishing apparatus according to the invention may have a diameter smaller than that of the object of polish 1523. If such is the case, it is possible to polish part of the object of polish 1523. Alternatively, the diameter of the polishing pad 1525 may be more than twice of that of the object of polish 1523.

[Fourteenth Embodiment]

A fourteenth embodiment of polishing apparatus according to the invention is characterized in that the secondary canister is provided with a promotion means for encouraging particles in the slurry contained in the secondary canister to reaggregate. Otherwise, this embodiment is identical with the third embodiment.

Figure 19:
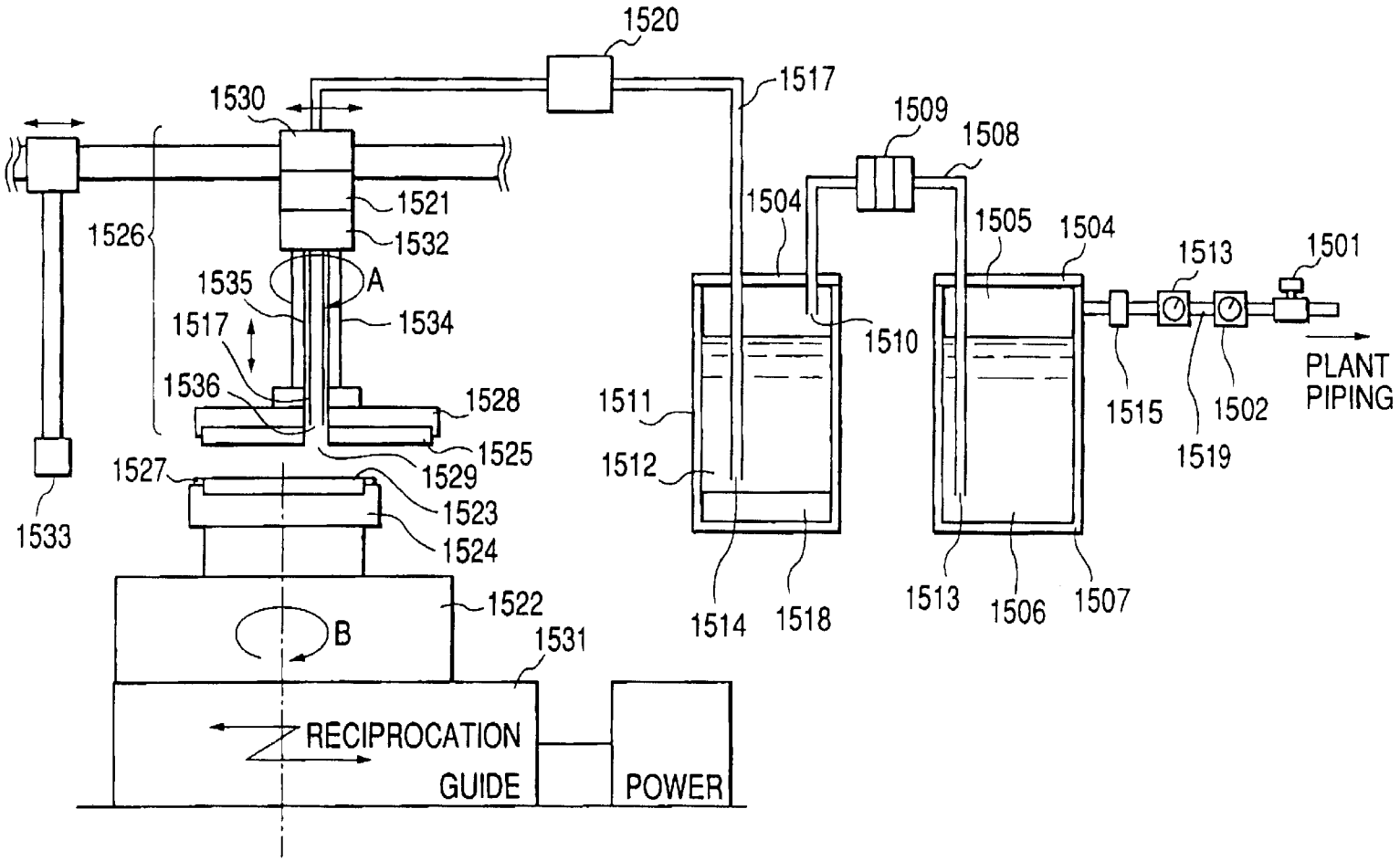
FIG. 19 is a schematic illustration of a fourteenth embodiment of a polishing apparatus according to the invention.

FIG. 19 is a schematic illustration of the fourteenth embodiment of a polishing apparatus according to the invention. Referring to FIG. 19, the secondary canister 1511 is provided with a promotion means, which is a vibration generating means 1518 for encouraging particles in the slurry contained in the secondary canister 1511 to aggregate and a tube 1517 for supplying slurry 1512 to the polishing head.

While the slurry 1512 is held in the secondary canister 1511, the vibration generating means 1518 vibrates the slurry with a varying amplitude and a varying frequency to such an extent that the slurry 1512 may not show any convective motion but may encourage dispersed particles to contact one another more frequently. As a result, this embodiment of polishing apparatus can reduce the time required for fine particles to reaggregate.

While the promotion means of this embodiment of a polishing apparatus is a vibration generating means for applying vibration to the slurry 1512 in order to reduce the time required for fine particles to reaggregate in a manner as described above, it may be replaced by a bubble generating means for generating air bubbles in the slurry.

[Fifteenth Embodiment]

A fifteenth embodiment of the present invention is characterized in that the inlet 1514 of the tube 1517 in the secondary canister 1511 is located above the outlet 1536 and the primary canister is located below the level of the polishing head and the object-of-polish-holding means. Otherwise, this embodiment is identical with the thirteenth and the fifteenth embodiments.

Figure 20:
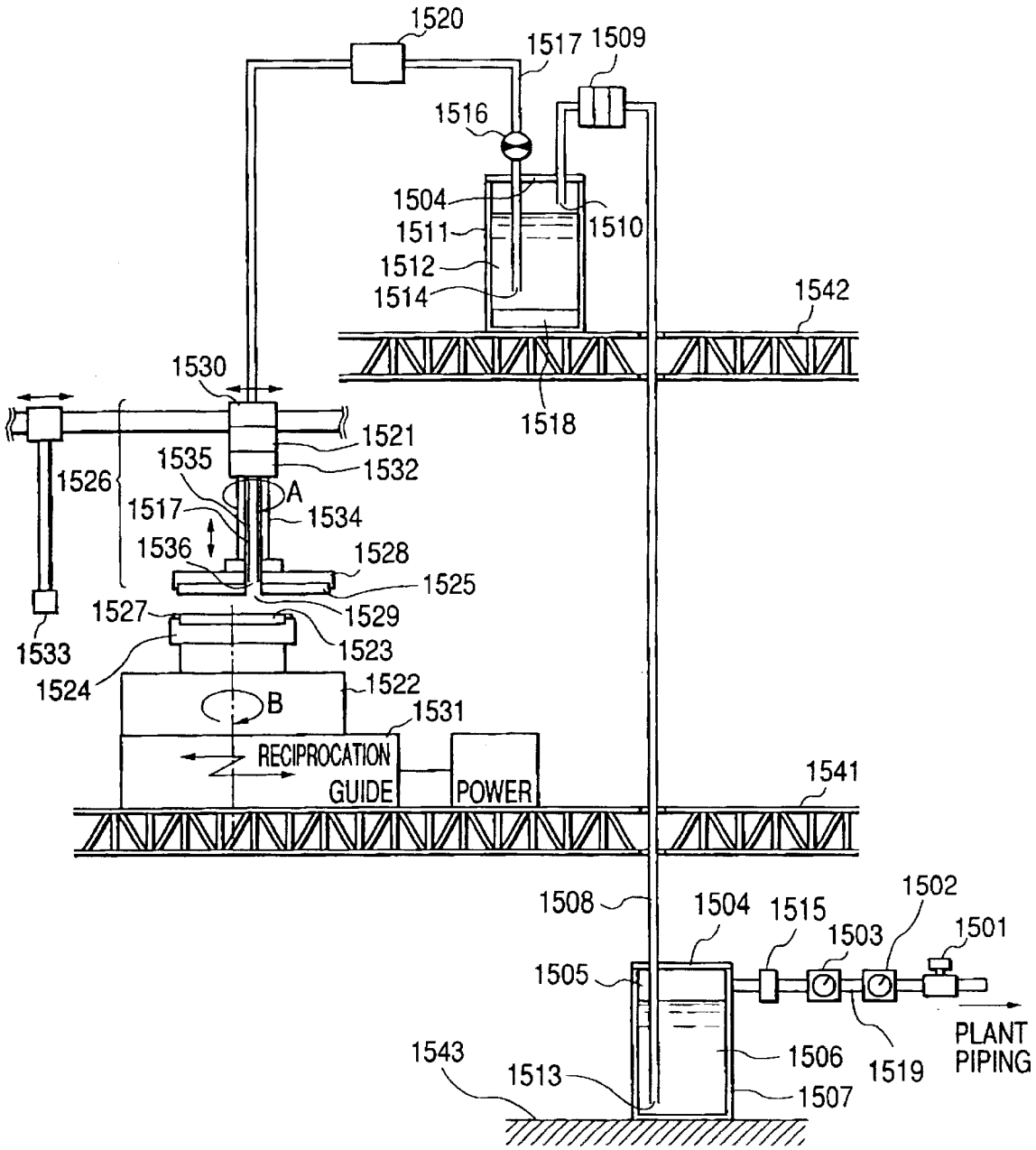
FIG. 20 is a schematic illustration of a fifteenth embodiment of a polishing apparatus according to the invention.
Figure 21:
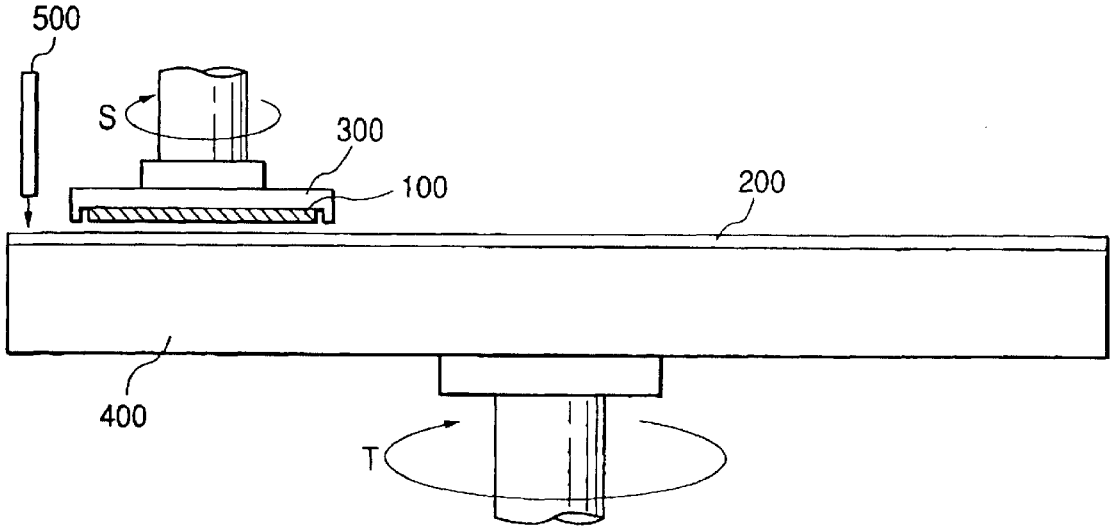
FIG. 21 is a schematic illustration of a known polishing apparatus.

FIG. 20 is a schematic illustration of this embodiment of polishing apparatus as installed in a clean room where clean air is made to flow downwardly from above and from floor 1542 to floor 1543 by way of floor 1541.

Referring to FIG. 20, the secondary canister 1511 is arranged on the floor 1542 located above the floor 1541 for supporting the polishing head 1526 and the object-of-polish-holding means 1524. The tube 1508 extends from the floor 1543 where the primary canister 1507 is arranged to the floor 1542 where the secondary canister 1511 is arranged through the floor 1541 supporting the polishing head 1526 and the object-of-polish-holding means 1524. The filter 1509 is located at a position close to the outlet 1510 of the tube 1508.

Since the inlet 1514 of the tube 1517 is located above the outlet 1536, slurry 1512 can easily by transferred from the secondary canister 1511 to the outlet 1536 if the secondary canister 1511 is opened to make its internal pressure equal to the atmospheric pressure.

The primary canister 1507 is arranged on the floor 1543 located below the floor 1541 supporting the polishing head 1526 and the object-of-polish-holding means 1524. As a result, any vibrations that may be produced by ultrasonic wave generating means and/or the gas supply means are prevented from being transmitted to the floor 1541 carrying the polishing head 1526 and the object-of-polish-holding means 1524.

Additionally, since the primary canister 1507 is hermetically sealed, no dirt will be allowed to enter the slurry contained in it from outside. Therefore, the polishing head and the object-of-polish-holding means can be arranged on the floor 1543 located below the floor 1541 supporting the polishing head and the object-of-polish-holding means and hence downstream relative to the clean room.

As described above in detail, according to the invention, it is now possible to prevent large diameter particles from being fed to the object of polish with slurry and thereby from forming unexpected scars on the surface of the object of polish by means of a polishing apparatus of the type, comprising an object-of-polish-holding means for holding an object of polish and a polishing head, and adapted to polish said object of polish by causing the polishing surface of said polishing head to abut said object of polish, while supplying slurry to said object of polish held by said object-of-polish-holding means, because said polishing apparatus further comprises a large-diameter-particle-screening means.

Additionally, large diameter particles passing through the intake pipe can be fractionized by arranging a fractionizing means at the intake pipe as the large-diameter-particle-screening means.

Alternatively, large diameter particles passing through the intake pipe can be screened off by arranging a filter at the intake pipe as the large-diameter-particle-screening means.

Alternatively, large diameter particles can be prevented from entering the container from the outside by using a hermetically sealable container as the large-diameter-particle-screening means.

According to the invention, it is now possible to fractionize almost all the particulate aggregates contained in the slurry flowing through a flow path running in a given direction into fine particles by a fractionizing means arranged along the flow path.

Almost all the slurry contained in the container is taken up into the intake pipe and passes therethrough. Additionally, almost all the particulate aggregates contained in the slurry flowing through the intake pipe can be fractionized by a fractionizing means arranged at the intake pipe before the slurry is fed to the object of polish.

Thus, since the slurry fed to the object of polish is free from particulate aggregates, it is now possible to prevent unexpected scars from being formed on the surface of the object of polish.

As a result, the efficiency of the use of slurry is improved to reduce the manufacturing cost. Additionally, it is now possible to continuously supply slurry containing no large particles and produce polished products that are free from scars at high yield to further reduce the manufacturing cost.

According to the invention, almost all the particulate aggregates contained in the slurry in the first container can be fractionzed into fine particles. Unfractionized large diameter particles can be screened off by means of a filter. The fine particles contained in the slurry in the second container can be made to grow to show a uniform size preferable for polishing. Thus, slurry that is free from large particles and containing only particles of uniform size can be fed to the object of polish for polishing.

As a result it is now possible to reduce the consumption of slurry. Then, it is possible to polish objects at high yield to further reduce the manufacturing cost.

According to the invention, it is possible to transfer the slurry contained in a hermetically sealable container by way of a feed pipe without being exposed to the atmosphere by supplying compressed gas into the container so that large diameter particles contained in the atmosphere can be effectively prevented from entering the slurry contained in the container.

Additionally, the slurry contained in the container is prevented from evaporating because the container is hermetically sealable.

As a result, slurry containing evenly dispersed particles can be fed to the object of polish for a prolonged period of time.

Additionally, it is now possible to produce polished products at high yield by using slurry containing no large particles to reduce the manufacturing cost.

As a result, it is now possible to reduce the consumption of slurry to further reduce the manufacturing cost.

What is claimed is:

1. A polishing apparatus, comprising:

holding means for holding an object to be polished;

a polishing head having a polishing surface;

a polishing head driver to operate said polishing head, with said polishing head operated to polish the object with said polishing surface while being supplied with a slurry;

a container for containing the slurry;

an intake pipe for delivering the slurry from said container to said polishing head; and fractionizing means for fractionizing particulate aggregates contained in the slurry flowing through said intake pipe into fine particles.

2. A polishing apparatus according to claim 1, wherein said fractionizing means is an ultrasonic wave generating means.

3. A polishing apparatus according to claim 2, wherein said ultrasonic wave generating means has a vibration surface arranged longitudinally along said intake pipe.

4. A polishing apparatus according to claim 3, wherein said vibration surface of said ultrasonic wave generating means is arranged vis-a-vis the slurry flowing through said intake pipe.

5. A polishing apparatus according to claim 2, wherein said ultrasonic wave generating apparatus has a horn for amplifying the ultrasonic wave produced by its ultrasonic wave vibrator.

6. A polishing apparatus according to claim 5, wherein the vibration surface of said horn is arranged vis-a-vis the slurry flowing through said intake pipe.

7. A polishing apparatus according to claim 5, wherein the vibration surface of said horn is greater than the cross section of said intake pipe.

8. A polishing apparatus according to claim 1, wherein said intake pipe for feeding the slurry to the object to be polished.

9. A polishing apparatus according to claim 8, wherein the inlet of said feed pipe is arranged in a lower part of a containing space of said container.

10. A polishing apparatus according to claim 8, wherein said feed pipe is partly arranged within said polishing head.

11. A polishing apparatus according to claim 1, wherein said intake pipe is a circulation pipe for taking up the slurry from said container and feeding it to said container.

12. A polishing apparatus according to claim 11, wherein the inlet of said circulation pipe is arranged in a lower part of a containing space of said container.

13. A polishing apparatus according to claim 11, further comprising a feed pipe for feeding the slurry from said container to the object to be polished.

14. A polishing apparatus according to claim 13, wherein said feed pipe is partly arranged within said polishing head.

15. A polishing apparatus according to claim 13, wherein the inlet of said feed pipe is arranged in a lower part of a containing space of said container.

16. A polishing apparatus according to claim 1, wherein said intake pipe includes a filter for filtering out particulate aggregates from the slurry after the slurry passes through said fractionizing means.

17. A polishing apparatus according to claim 16, wherein said filter comprises a plurality of filters having respective pore sizes that are different from each other.

18. A polishing apparatus according to claim 1, further comprising a plurality of said containers.

19. A polishing apparatus according to claim 1, wherein said container is hermetically sealable.

20. A polishing apparatus according to claim 19, further comprising a gas supply means for supplying gas to said hermetically sealable container.

* * * * *

UNITED STATES PATENT AND TRADEMARK OFFICE

CERTIFICATE OF CORRECTION

PATENT NO. : 6,352,469 B1
DATED : March 5, 2002
INVENTOR(S) : Kyoichi Miyazaki et al.

It is certified that error appears in the above-identified patent and that said Letters Patent is hereby corrected as shown below:

Column 15,
Line 43, “franctionizing” should read -- fractionizing --.

Column 33,
Line 25, “pipe” should read -- pipe is a feed pipe --.

Signed and Sealed this

Twenty-second Day of October, 2002

*Attest:*

*Attesting Officer*

JAMES E. ROGAN
*Director of the United States Patent and Trademark Office*